US008763933B2

(12) United States Patent
Hayakawa

(10) Patent No.: US 8,763,933 B2
(45) Date of Patent: Jul. 1, 2014

(54) SPRAYER

(75) Inventor: Koichi Hayakawa, Tokyo (JP)

(73) Assignee: Terumo Kabushiki Kaisha, Shibuya-Ku, Tokyo (JP)

( * ) Notice: Subject to any disclaimer, the term of this patent is extended or adjusted under 35 U.S.C. 154(b) by 640 days.

(21) Appl. No.: 12/564,429

(22) Filed: Sep. 22, 2009

(65) Prior Publication Data

US 2010/0072303 A1 Mar. 25, 2010

(30) Foreign Application Priority Data

Sep. 25, 2008 (JP) ..... 2008-246797

(51) Int. Cl.
*F23D 11/16* (2006.01)

(52) U.S. Cl.
USPC ..... 239/419.3; 239/422; 239/427.5; 239/428; 239/487; 239/501

(58) Field of Classification Search
CPC ..... B05B 7/26; B05B 7/262; B05B 7/267; B05B 7/0408; B05B 7/0416; B05B 7/0483; B05B 7/04; B05B 1/262; B05B 1/265; B05B 1/3405; B05B 1/341
USPC ..... 239/422–424, 427.5, 428, 486, 487, 239/489, 491, 419–419.5, 432, 500, 501
See application file for complete search history.

(56) References Cited

U.S. PATENT DOCUMENTS 871,182 A * 11/1907 Paasche ..... 432/88
4,846,405 A 7/1989 Zimmermann
5,582,596 A 12/1996 Fukunaga et al.
5,755,362 A 5/1998 Rodrigues, Jr. et al.
6,461,325 B1 10/2002 Delmotte et al.
6,464,663 B1 10/2002 Zinger
2003/0187408 A1 10/2003 Marx
2004/0124217 A1 7/2004 Yquel et al.
2007/0005007 A1 1/2007 Hoogenakker et al.

(Continued)

FOREIGN PATENT DOCUMENTS

EP 1 955 660 A2 8/2008
GB 1 221 625 2/1971

(Continued)

OTHER PUBLICATIONS

U.S. Appl. No. 12/068,533, filed Feb. 7, 2008, Yokoyama et al.

(Continued)

*Primary Examiner* — Christopher Kim
(74) *Attorney, Agent, or Firm* — Buchanan Ingersoll & Rooney PC

(57) ABSTRACT

A sprayer capable of avoiding clogging caused in the nozzle includes liquid supplies for supplying a liquid, and a nozzle connected to the liquid supply. The nozzle includes a first internal tube and a second internal tube through which a first liquid and a second liquid supplied from the liquid supply pass, respectively, and an external tube into which respective internal tubes are inserted, and which allows a gas to pass through the gap between it and each internal tube, for ejecting the first liquid and the second liquid with the gas. At least a part of the longitudinal direction of each internal tube is formed of a coil including a helically wound wire rod, so that the gas can flow into the inside of the coil from between the adjacent portions of the wire rod of the coil.

6 Claims, 15 Drawing Sheets

(56) References Cited

U.S. PATENT DOCUMENTS

| | | | |
|---|---|---|---|
| 2008/0272209 | A1 | 11/2008 | Yokoyama et al. |
| 2008/0294099 | A1 | 11/2008 | Yatabe et al. |
| 2009/0005731 | A1 | 1/2009 | Yokoyama |
| 2009/0124986 | A1 | 5/2009 | Hayakawa |
| 2009/0234326 | A1 | 9/2009 | Hayakawa |

FOREIGN PATENT DOCUMENTS

| | | | |
|---|---|---|---|
| JP | 07-100209 | A | 4/1995 |
| JP | 09-296039 | A | 11/1997 |
| JP | 11-502464 | A | 3/1999 |
| JP | 2001-057979 | A | 3/2001 |
| JP | 2001-515401 | A | 9/2001 |
| JP | 2002-282368 | A | 10/2002 |
| JP | 2005-152790 | A | 6/2005 |
| WO | WO 91/03224 | A1 | 3/1991 |
| WO | WO 95/31138 | A1 | 11/1995 |

OTHER PUBLICATIONS

U.S. Appl. No. 12/120,041, filed May 13, 2008, Yatabe et al.
U.S. Appl. No. 12/199,880, filed Aug. 28, 2008, Yokoyama.
U.S. Appl. No. 12/265,498, filed Nov. 5, 2008, Hayakawa.
U.S. Appl. No. 12/402,262, filed Mar. 11, 2009, Hayakawa.

* cited by examiner

SPRAYER

TECHNOLOGICAL FIELD

The present invention generally relates to a device for delivering a liquid material. More specifically, the invention pertains to a sprayer having useful application in the medical field for spraying a liquid at a body region.

BACKGROUND DISCUSSION

There is known a method in which two or more liquids are mixed and ejected to the affected part or the like to form an anti-adhesive material, a biological tissue adhesive, or the like. A sprayer for this purpose is used.

Such a sprayer is configured to feed components which coagulate upon mixing, such as a thrombin-containing solution and a fibrinogen-containing solution, in a mutually separated manner to the vicinity of the affected part, and to spray them at the affected part while mixing.

A known sprayer disclosed in Japanese Application Publication No. 2002-282368 includes two syringes respectively containing different types of liquids, and a nozzle for mixing the liquids from respective syringes, and spraying the mixture. The nozzle is connected to a gas supply source for supplying an aseptic gas, so that the liquids are sprayed together with the aseptic gas. The nozzle is specifically configured in a double tube structure including two internal tubes through which the liquids from respective syringes pass, respectively, and an external tube in which the two internal tubes are inserted, and which passes the gas between it and these internal tubes. Then, in respective inner tubes, the distal end openings respectively function as liquid ejection ports for respectively ejecting the liquids. Whereas, in the external tube, the distal end opening includes the liquid ejection ports disposed in the inside thereof, and functions as a gas ejection port for ejecting a gas.

With the nozzle configured, in this manner, upon stopping the liquid ejection operation, the residual pressures in respective internal tubes cause the liquids to eject outward from the liquid ejection ports in the respective internal tubes. In this state, the liquids are mixed with each other so that the liquids coagulate. As a result, clogging occurs in each liquid ejection port. Further, the liquids ejected from the liquid ejection ports of respective internal tubes outward also respectively extend to the gas ejection port. Accordingly, the liquids are also mixed with each other to coagulate at the gas ejection port, resulting in clogging. Then, when the clogged sprayer is used to try to performing spraying again, the coagulated liquids inhibit the ejection of the liquids from respective liquid ejection ports, and the ejection of the gas from the gas ejection port. Thus, respraying or further spraying cannot be performed.

SUMMARY

In accordance with the sprayer disclosed here, the liquid ejects together with a gas which has flowed from the inside of the external tube into the internal tube through a coil or coil-like member. Then, when the ejection of the liquid is stopped, the residual pressure in the external tube causes the gas to flow into the internal tube through the coil or coil-like member. As a result, it is possible to blow off the liquid in the internal tube to the outside. This can help prevent the occurrence of clogging in the nozzle.

Further, the gas ejects outwardly from the inside of the internal tube together with the liquid. For this reason, it is possible to omit the provision of a gas ejection port for ejecting a gas as with a conventional sprayer. This can simplify, for example, the configuration of the nozzle.

According to one aspect, a sprayer comprises a first liquid supply comprising a first liquid having a first composition, a second liquid supply comprising a second liquid having a second composition different from the first composition, a gas supply comprising a gas, and a nozzle comprised of an outer tube possessing an interior, a first internal tube positioned in the interior of the outer tube, and a second internal tube positioned in the interior of the outer tube. The first internal tube is connected to the first liquid supply so the interior of the first internal tube is in fluid communication with the first liquid supply so the first liquid from the first liquid supply is flowable into the interior of the first internal tube during operation of the sprayer. The second internal tube is connected to the second liquid supply so the interior of the second internal tube is in fluid communication with the second liquid supply so the second liquid from the second liquid supply is flowable into the interior of the second internal tube during operation of the sprayer. The interior of the outer tube is connected to the gas supply so that the interior of the outer tube is in fluid communication with the gas supply so the gas from the gas supply is flowable into the interior of the outer tube during operation of the sprayer. A coil is located in the interior of the outer tube, and the coil comprises a plurality of adjacent helical windings surrounding an interior of the coil, with the interior of the coil being in fluid communication with the interior of the outer tube such that gas flowing into the interior of the outer tube from the gas source during operation of the sprayer flows between the adjacent helical windings and into the interior of the coil. The interior of the first internal tube is in fluid communication with the interior of the coil so that the first liquid flows through both the first internal tube and the coil According to another aspect, the sprayer comprises a main body that includes a first receiver for receiving a first liquid supply comprised of a first liquid and a second receiver for receiving a second liquid different from the first liquid, and a nozzle comprised of an outer tube possessing an interior, a first internal tube positioned in the interior of the outer tube, and a second internal tube positioned in the interior of the outer tube. The first internal tube possesses an interior configured to communicate with the first liquid supply when the first liquid supply is received in the first receiver so the first liquid from the first liquid supply is flowable into the interior of the first internal tube during operation of the sprayer. The second internal tube possesses an interior configured to communicate with the second liquid supply when the second liquid supply is received in the second receiver so the second liquid from the second liquid supply is flowable into the interior of the second internal tube during operation of the sprayer. The interior of the outer tube is connected to a tube which is adapted to be fluidly connected to a gas supply comprising gas so that the interior of the outer tube is in fluid communication with an interior of the tube so the gas from the gas supply is flowable into the interior of the outer tube during operation of the sprayer when the gas supply is connected to the tube. A helically extending member is located in the interior of the outer tube, with the helically extending member surrounding an interior of the helically extending member and comprising a helically extending gap fluidly communicating the interior of the outer tube and the interior of the helically extending member so that the gas flowing into the interior of the outer tube from the gas source during operation of the sprayer flows through the helically extending gap. The interior of the first internal tube is in fluid communication with the interior of the helically extending member so that the first liquid flowing through both the first internal tube and through the interior of the coil.

According to a further aspect, a sprayer comprises liquid supply means for supplying a liquid, and a nozzle connected to the liquid supply means. The nozzle comprises at least one internal tube having an interior in fluid communication with the liquid supply means. The nozzle also comprises an external tube having an interior in which is positioned the internal tube, the interior of the external tube being connectable to a gas source so that gas from the gas flows into the interior of the exterior tube during operation of the sprayer. A coil is positioned in the interior of the external tube and comprises a helically extending wire body surrounding an interior, with a helical gap between adjacent windings of the wire body communicating the interior of the external tube with the interior of the coil, and the interior of the coil receiving the first liquid flowing through the interior of the internal tube.

DETAILED DESCRIPTION

Figure 1:
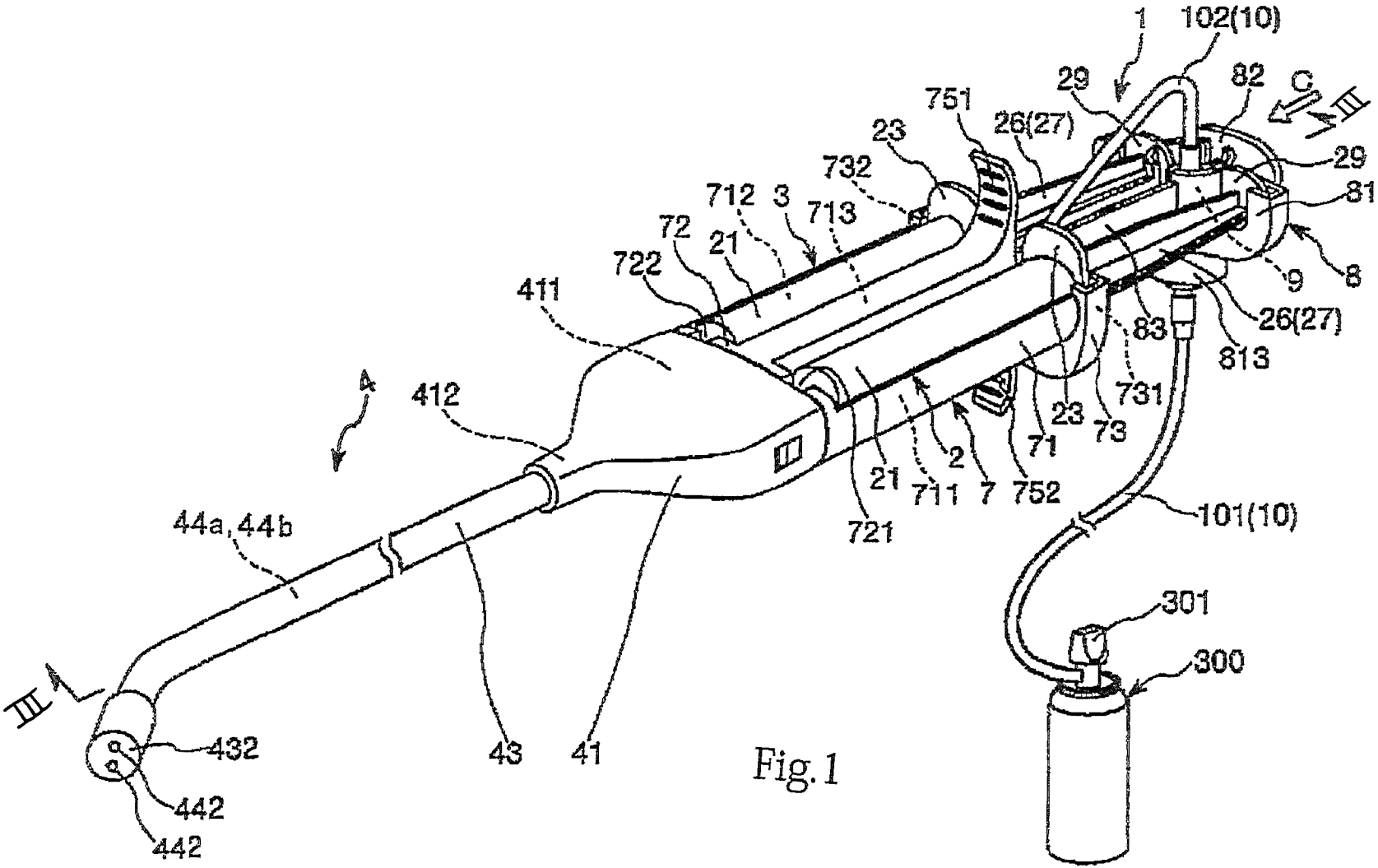
FIG. 1 is a perspective view of a first embodiment of a sprayer disclosed here.
Figure 2:
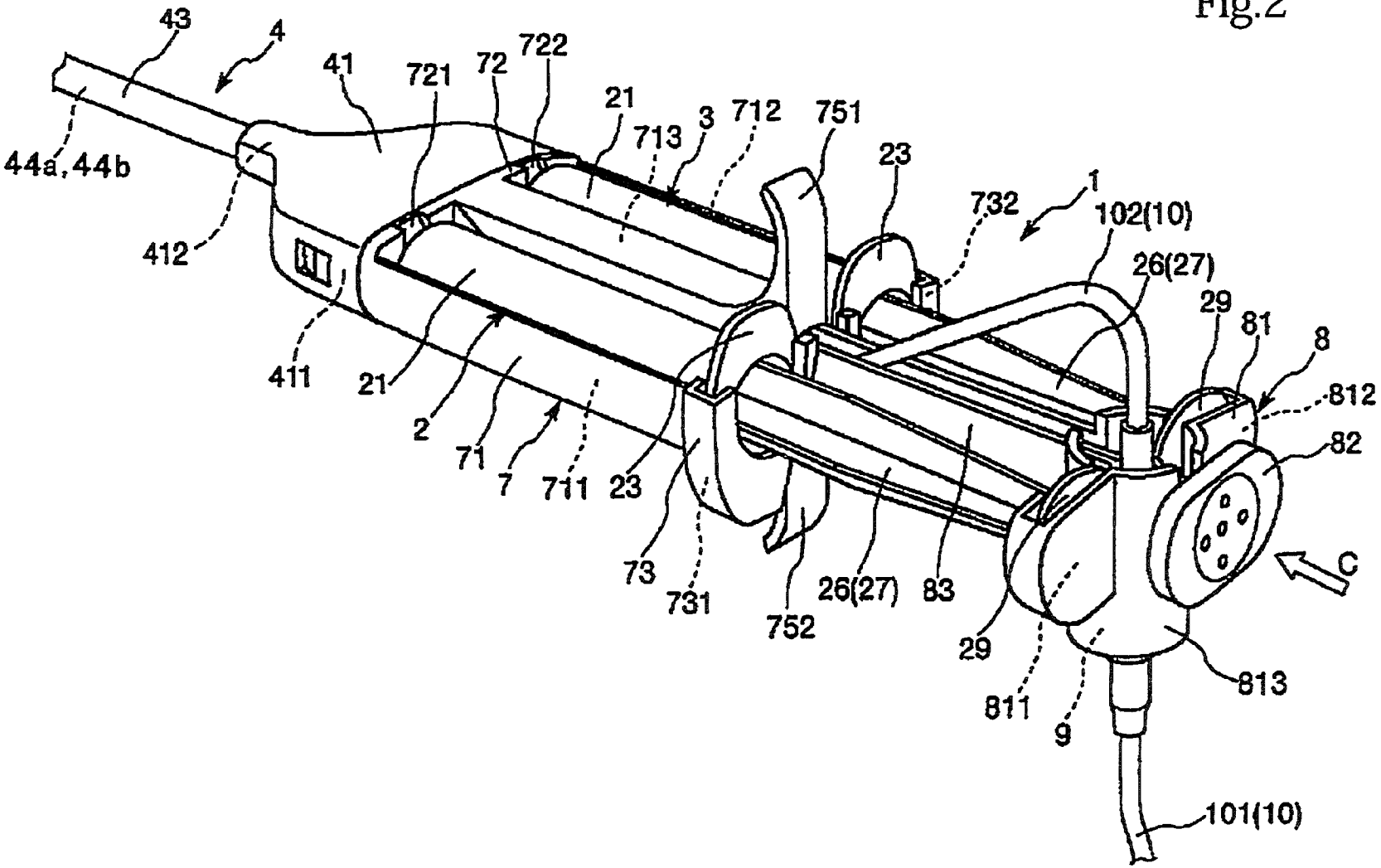
FIG. 2 is a different perspective view of the first embodiment of the sprayer shown in FIG. 1.
Figure 3:
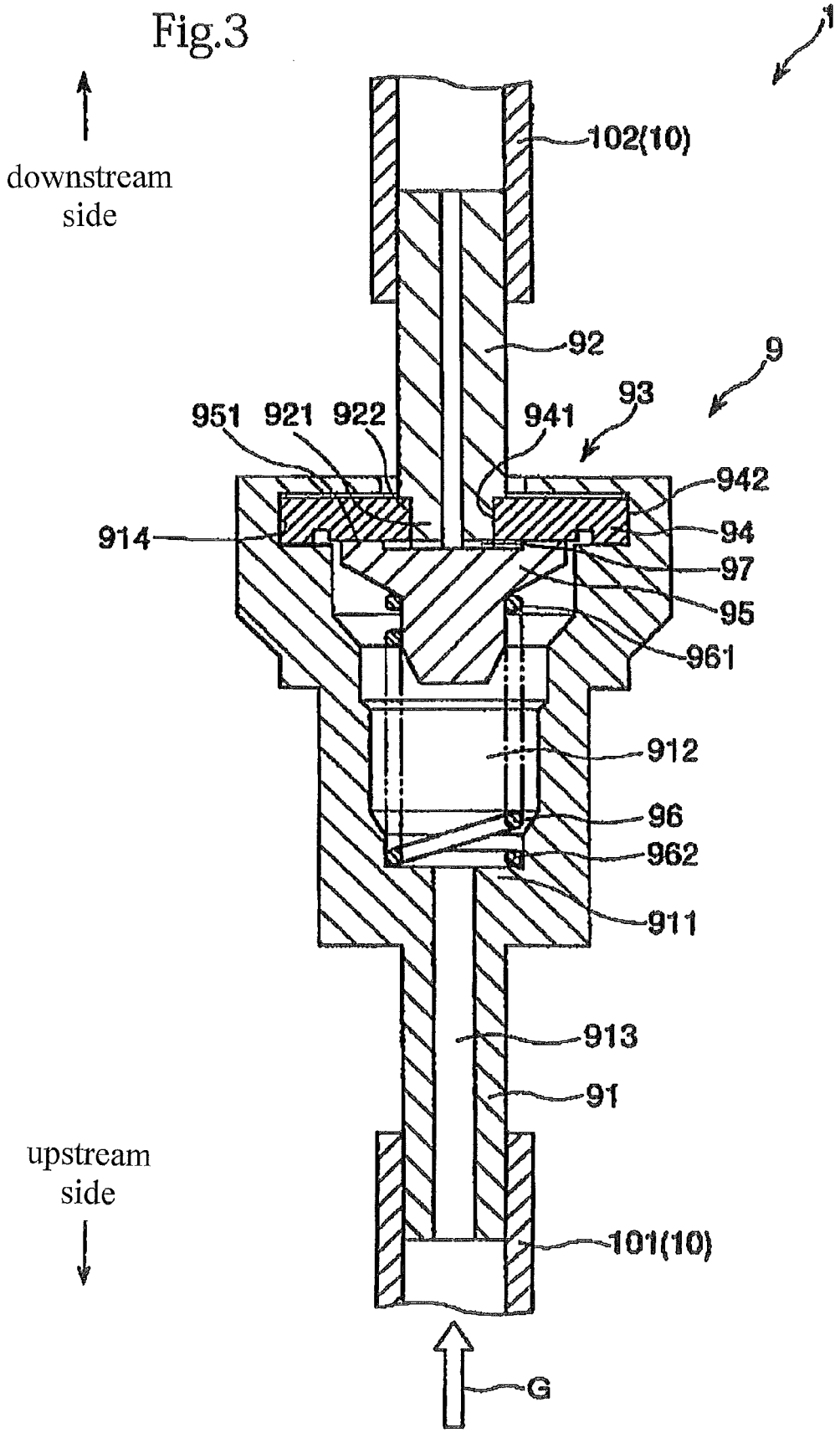
FIG. 3 is a cross-sectional view of the sprayer along section line III-III in FIG. 1 illustrating an opening and closing means in a state in which a gas flow path is shut off.
Figure 4:
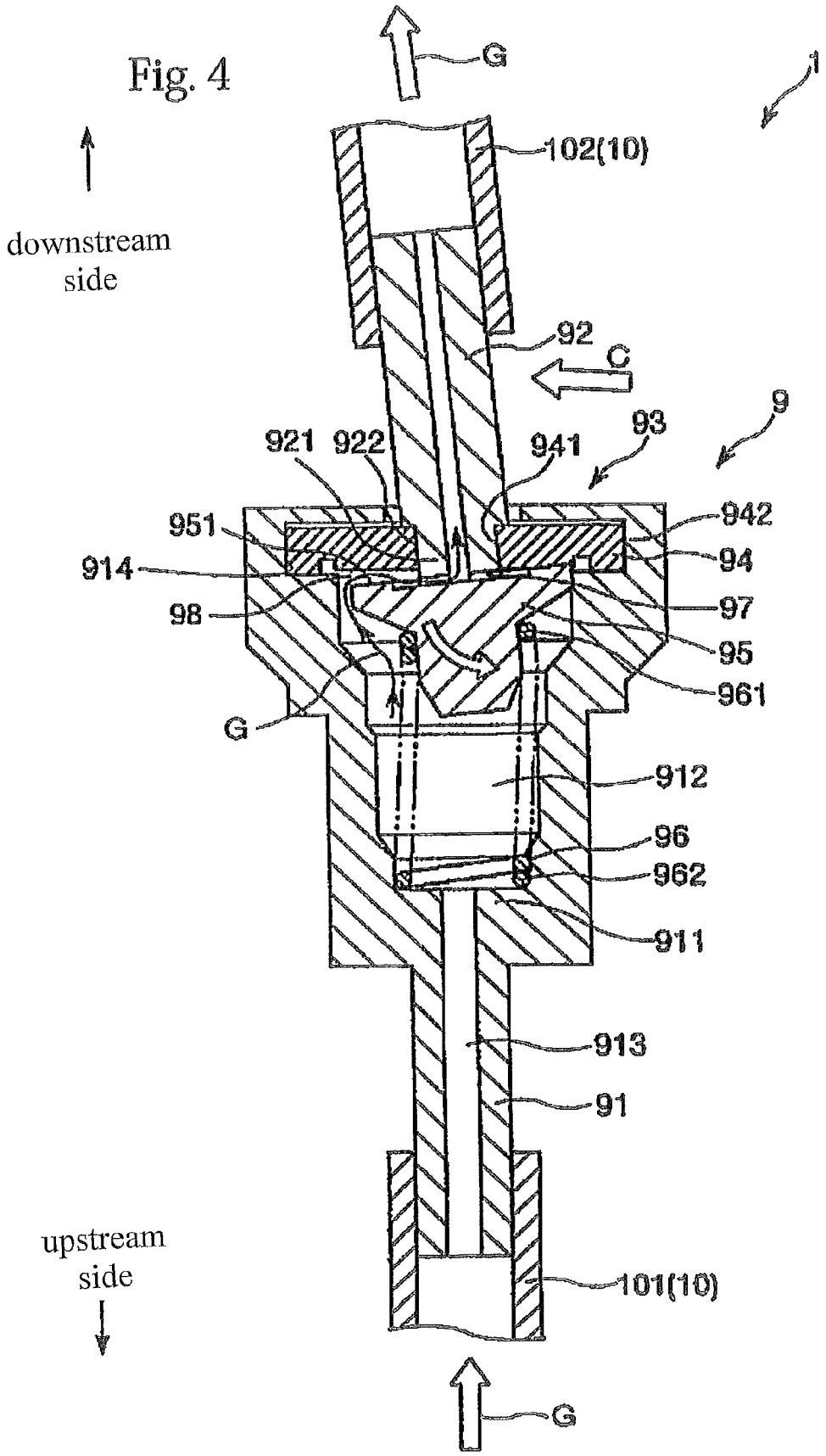
FIG. 4 is a cross-sectional view similar to FIG. 3, except illustrating the state in which a gas flow path is open.

FIGS. 1-9 illustrate various features and operational aspects/states of the sprayer disclosed here. For convenience of description, the left hand side in FIGS. 1, 2 and 5-9 (as well as FIGS. 10-14) is referred to as the "distal end", and the right hand side is referred to as the "rear end" or "proximal end". In FIG. 15, which illustrates the syringe to be used with the sprayer, the lower side is referred to as the "distal end", and the upper side is referred to as the "rear end". Further, in FIGS. 1-4, the upper side is referred to as the "top" and the lower side is referred to as the "bottom". With reference to FIGS. 3 and 4, the gas flows from the upstream side to the downstream side. Further, in FIGS. 5-9 (as well as FIGS. 10-14), to facilitate an understanding of the disclosure here, the external diameter of the wire rod forming the coil, and the pitch between the adjacent portions of the wire rod, are shown in an exaggerated manner.

Figure 7:
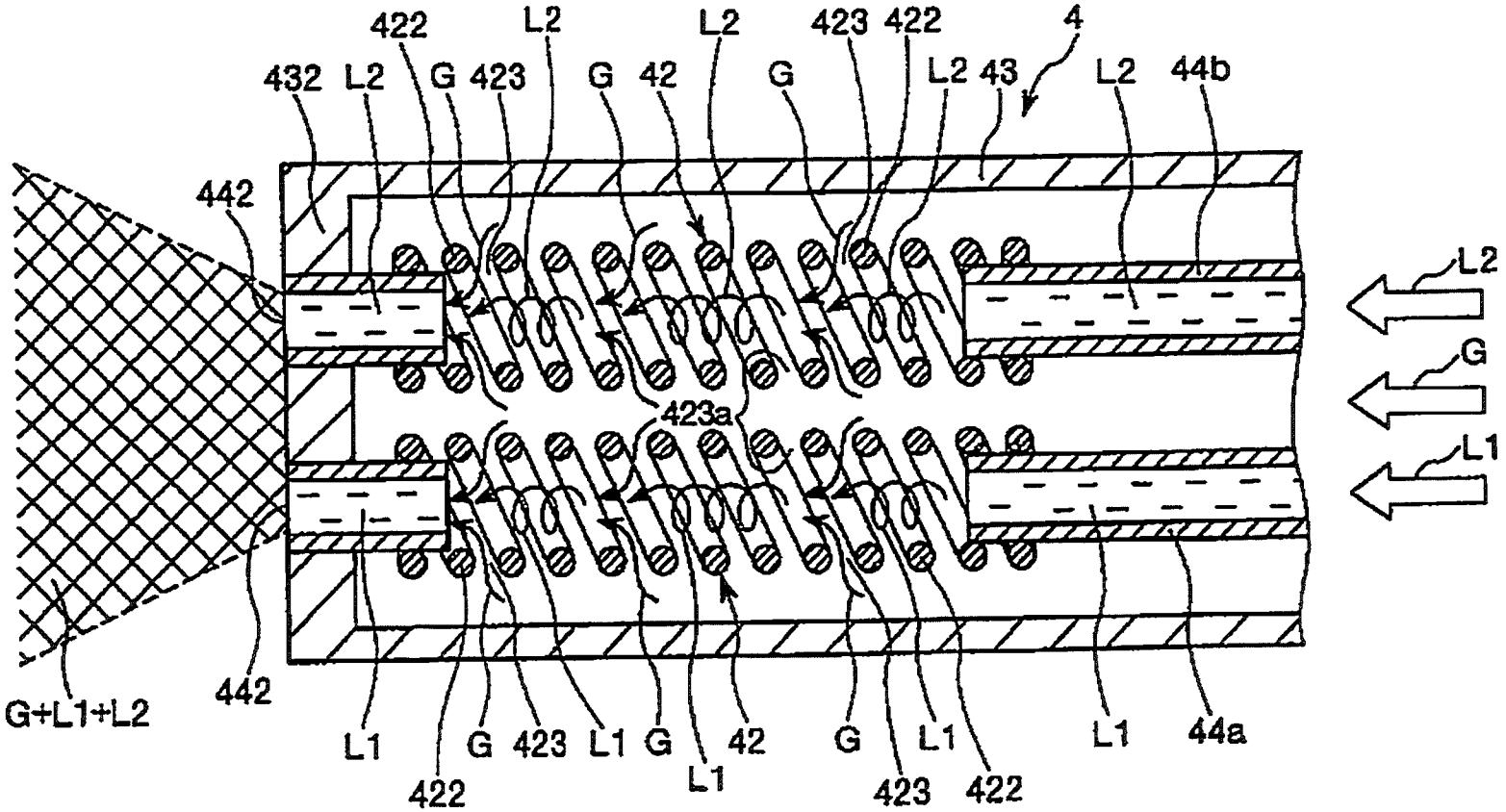
FIG. 7 is a longitudinal cross-sectional view similar to FIG. 5 illustrating the nozzle at another time in the sprayed state.

The sprayer 1 disclosed here is adapted to spray two types of liquids that are different in liquid composition from each other, a first liquid L1 and a second liquid L2, while mixing the liquids as generally illustrated in FIG. 7. As shown in FIGS. 1 and 2, the sprayer 1 is used with a first syringe or liquid supply 2 for storing the first liquid L1 and a second syringe or liquid supply 3 for storing the second liquid L2. The syringes 2, 3 are mounted in the sprayer. The first syringe 1 constitutes a first liquid supply means for supplying the first liquid L1, while the second syringe 2 constitutes a second liquid supply means for supplying the second liquid L2.

FIG. 15 generally illustrates the first syringe 2. The second syringe 3 has a construction that is the same as that shown in FIG. 15 and so the following description of the first syringe 2 applies equally to the second syringe 3. The first syringe 2 contains or is filled with the first liquid L1 before being mounted in the sprayer 1. The first liquid L1 is contained in a space 20 surrounded by the external tube 21 and a gasket 24.

Also the space 20 in the second syringe 3 is filled with the second liquid L2.

The composition of the first liquid L1 to be filled in the first syringe 2 differs from the composition of the second liquid L2 to be filled in the second syringe 3.

The first liquid L1 and the second liquid L2 are appropriately selected according to the use of the sprayer 1, the intended purpose, the case, and the like. For example, when the sprayer is to administer a biological tissue adhesive (e.g., a medical adhesive applied to a cut on the skin or a sutured area), one of the first liquid L1 and the second liquid L2 is preferably a liquid containing thrombin, and the other is preferably a liquid containing fibrinogen.

Alternatively, when the sprayer is used to administer an anti-adhesive material (e.g., a medical anti-adhesive applied, for example, during an operation/medical procedure to prevent adhesion between organs), one of the first liquid L1 and the second liquid L2 is preferably a liquid containing carboxymethyl dextrin modified with a succinimidyl group, and the other liquid is preferably a liquid containing disodium hydrogenphosphate.

Upon mixing the first liquid L1 and the second liquid L2, the two liquids together gelate. The gelation enables, for example, the mixture of the first liquid L1 and the second liquid L2 (hereinafter referred to as a "liquid mixture") to remain at the biological tissue (objective site) on which it has been sprayed. Further, the liquid mixture remains at the objective site. Therefore, the mixture can operate as a biological tissue adhesive or an anti-adhesive material at the objective site.

It is to be understood that the types and combinations of the first liquid L1 and the second liquid L2 are not limited to the ones mentioned above by way of example.

Respective plungers 26 of the first syringe 2 and the second syringe 3 are pressed and operated (i.e., moved axially) during operation of the sprayer as discussed in more detail below. As a result, it is possible to supply the first liquid L1 into the first internal tube 44*a* of a nozzle 4, and the second liquid L2 into the second internal tube 44*b* with relative ease and reliability. The pressing operation of each plunger 26 is manually carried out by an operator of the sprayer 1. For this reason, the operator can carry out spraying of the liquid mixture at his/her own discretion.

As generally illustrated in FIG. 1, the sprayer 1 in which the first syringe 2 filled with the first liquid L1 and the second syringe 3 filled with the second liquid L2 are mounted includes or comprises a sprayer main body 7, the nozzle 4, an operation part 8, an opening and closing means (valve mechanism) 9, and a tube (gas flow path) 10 connected to a cylinder or gas supply 300. The cylinder 300 constitutes a gas supply means for supplying gas.

Before describing in more detail the various parts of the sprayer 1, the cylinder 300 will be described.

The cylinder 300 includes an internal space containing or filled with a high pressure (compressed) gas G The cylinder 300 serves as the gas supply for the sprayer and so the cylinder 300 supplies the gas G to the sprayer 1 (nozzle 4). The cylinder 300 is outfitted with a closable valve 301 for controlling supply/stop of supply of the gas G with respect to the sprayer 1. When the sprayer 1 is used, the valve 301 is placed in an open state. The gas G is not particularly limited in type, though examples of suitable gas include carbon dioxide, air, nitrogen, oxygen, and the like. The gas G is preferably in an aseptic state, though this is not required. The internal pressure (gas pressure) in the cylinder 300 is preferably 0.01 MPa or more, more preferably 0.05 to 1 MPa.

As shown in FIGS. 1 and 2, the sprayer main body 7 is configured to fix or position the first syringe 2 and the second syringe 3 parallel to one another. The sprayer main body 7 comprises a base 71, a front plate or first fitting part 72 at the distal end of the base 71, a rear plate or second fitting part 73 at the rear end of the base 71, and finger rest parts 751, 752 in the vicinity of the rear plate 73 of the base 71.

The upper part of the base 71 includes concave parts 711, 712 which are roughly semi-circular arc-shaped in cross-section and are positioned parallel to one another. The external tube 21 of the first syringe 2 is stored or positioned in the concave part 711, while the external tube 21 of the second syringe 3 is positioned or stored in the concave part 712. Thus, the concave parts 711, 712 serve as liquid supply receivers that receive the first liquid supply and the second liquid supply.

The front plate 72 is positioned at the distal end of the base 71. In the front plate 72, grooves 721, 722 are formed at the positions respectively corresponding to the concave parts 711, 712. When the first syringe 2 and the second syringe 3 are mounted in the sprayer main body 7, the reduced diameter part 22 of the first syringe 2 is inserted into or positioned in the groove 721, and the reduced diameter part 22 of the second syringe 3 is inserted into or positioned in the groove 722.

The rear plate 73 is provided at the rear end of the base 71. In the rear plate 73, the concave parts 731, 732 are formed at the positions respectively corresponding to the concave parts 711, 712. When the first syringe 2 and the second syringe 3 are mounted in the sprayer main body 7, the flange 23 or proximal end part of the first syringe 2 is fitted or inserted into the concave part 731, and the flange 23 or proximal end part of the second syringe 3 is fitted or inserted into the concave part 732.

Thus, in the sprayer main body 7, the reduced diameter part 22 of each syringe is fitted into the front plate 72, and the flange 23 of each syringe is fitted into the rear plate 73. As a result, the first syringe 2 and the second syringe 3 are fixed in the sprayer main body 7 parallel to one another.

In the vicinity of the rear plate 73 of the base 71, the finger rest parts 751, 752 are provided. The user is able to rest his/her fingers on the finger rest parts 751, 752 during use of the sprayer 1. The finger rest part 751 is formed as an upwardly protruding plate piece, and the finger rest part 752 is formed as a downwardly protruding plate piece. Further, respective finger rest parts 751, 752 are each configured such that the side facing the distal end direction forms a circular arc (curved concave shape).

The sprayer main body 7 may be configured such that respective parts forming the sprayer main body 7 are integrally formed. Alternatively, the sprayer main body 7 may be configured such that respective parts are formed as separate parts that are bonded or otherwise connected together.

The material of which the sprayer main body 7 is fabricated is not limited to a specific material. By way of example, various metal materials, various plastics, and the like may be used alone, or in combination.

The operation part 8 is set on the rear end side of the sprayer main body 7. The operation part 8 is set movably in the longitudinal direction with respect to the sprayer main body 7. The operation part 8 serves as a site for pressing and operating the plunger 26 of the first syringe 2 and the plunger 26 of the second syringe 3 in the direction of the distal end (in the direction of the arrow C in FIGS. 1, 2, and 4). The operation part 8 has a connection part 81 for connecting the flange 29 of the plunger 26 of each of the first syringe 2 and the second syringe 3, a pressing part 82 situated on the rear end side of the connection part 81, and a rail part 83 extending from the connection part 81 in the distal end direction.

The connection part 81 is provided with upwardly opening concave parts 811, 812. The concave part 811 possesses a shape corresponding to the flange 29 of the plunger 26 of the first syringe 2, and the flange 29 of the plunger 26 of the first syringe 2 is fitted in the concave part 81 as shown in FIG. 2. The concave part 812 possesses a shape corresponding to the flange 29 of the plunger 26 of the second syringe 3. As illustrated in FIG. 2, the flange 29 of the plunger 26 of the second syringe 3 is fitted in the concave part 812.

By virtue of the connection part 81 having such a configuration, it is possible to connect and fix the flanges 29 of the plungers 26 of the first syringe 2 and the second syringe 3. As a result, it is possible to move these plungers 26 integrally, at the same time, in the direction of the arrow C.

The connection part 81 includes a tubular part 813 between the concave part 811 and the concave part 812. The tubular part 813 is positioned so its axis is in parallel with the vertical direction in FIG. 1 (the same also applies to FIG. 2). Further, most of the opening and closing means 9 is stored in the tubular part 813.

The outer circumferential part of the tubular part 813 of the connection part 81 includes an elongated rail part 83 protruding toward the distal end direction. The rail part 83 is provided at the base 71 of the sprayer main body 7, and is positioned in an elongated guide 713. By pressing the operation part 8 in the direction of the arrow C, the rail part 83 is guided by the guide 713. As a result, it is possible to carry out the pressing operation relatively smoothly.

The plate-shaped pressing part 82 is set on the rear end side of the tubular part 813 of the connection part 81. The plate-shaped pressing part 82 is movable in the longitudinal direction of the sprayer main body 7.

The pressing part 82 is a site to be pressed by a user when the sprayer 1 is used, i.e., when the mixture is sprayed onto, for example, the affected part. When the sprayer 1 is used, an index finger can be rested on the finger rest part 751, a middle finger can be rested on the finger rest part 752, and a thumb can be rested on the pressing part 82. As a result, it is possible to grasp the sprayer 1 in a relatively stable manner. Further, it is possible to carry out the pressing operation of the operation part 8 (pressing part 82) with relative smoothness. This results in an improvement in the operability of the sprayer 1.

The pressing part 82 is connected to a second connection part 92 of the opening and closing means 9 as described below in more detail.

The material forming the operation part 8 is not particularly limited. For example, it is possible to employ the materials mentioned above in connection with the description of the materials which can be used to fabricate the sprayer main body 7.

As described above, the opening and closing means 9 is set in the tubular part 813 of the operation part 8. The opening and closing means 9 operates to shut off/open the flow of the gas G from the cylinder 300 to the nozzle 4. The first tube 101 and the second tube 102 are shut off/communicate with each other through the opening and closing means 9, i.e., by the operation of the opening and closing means 9. FIG. 3 illustrates the opening and closing means 9 in a condition which shuts off the first tube 101 and the second tube 102 from each other, while FIG. 4 illustrates the opening and closing means 9 in a condition permitting the first tube 101 and the second tube 102 to communicate with each other.

As shown in FIGS. 3 and 4, the opening and closing means 9 has a first connection part 91 connected to the first tube 101, a second connection part 92 connected to the second tube 102, and a closable valve part 93 stored or positioned in the first connection part 91.

The first connection part 91 is in the shape of a tube. A storage part 912 is provided in the bore of the first connection part 91. The storage part 912 is situated on the downstream side and the valve part 93 is stored or positioned in the storage part 912. Further, in the bore of the first connection part 91, there is provided a reduced diameter part 913 having a reduced diameter smaller than the inner diameter on the upstream side of the storage part 93. At the boundary between the reduced diameter part 913 and the storage part 912, there is formed a step part 911 exhibiting a sharp change in inner diameter.

The second connection part 92 is in the shape of a tube. As described above, the second connection part 92 is connected to the pressing part 82 of the operation part 8. The bottom part 921 of the second connection part 92 is supported by a sealing member 94 of the valve part 93. Thus, the second connection part 92 is set on the downstream side of the first connection part 91 via the sealing member 94. The second connection part 92 is displaceably or movably set in a first posture shown in FIG. 3 in which its axis is aligned (coaxial) with the first connection part 91 and in a second posture shown in FIG. 4 in which the axis of the second connection part 92 is tilted in the direction of the arrow C (direction of operation) of the pressing part 82 (operation part 8) with the bottom part 921 as the fulcrum.

The valve part 93 includes the sealing member 94 formed of an elastic material, a flange part 95 situated on the upstream side of the sealing member 94, and an urging part 96 for urging the flange part 95 toward the sealing member 94.

The sealing member 94 is in the shape of a ring. An inner circumferential part 941 of the sealing member 94 is in close contact with an outer circumferential part 922 of the bottom part 921 of the second connection part 92. An outer circumferential part 942 of the sealing member 94 is in close contact with an inner circumferential part 914 of the storage part 912 of the first connection part 91. By virtue of the sealing member 94 constructed in this way, the first connection part 91 and the second connection part 92 are connected in an air-tight manner via the sealing member 94.

The flange part 95 has an outer diameter larger than the outer diameter of the second connection part 92. The flange part 95 is disposed in opposing relation to the bottom side of the second connection part 92 via a gap 97.

In this embodiment, the urging part 96 is a compressed coil spring. In a compressed state, the upper edge 961 of the spring is in contact with the flange part 95, and the bottom part of the spring is in contact with the step part 911 of the first connection part 91. This tends to urge the flange part 95 to the side of the sealing member 94.

With the valve part 93 having such a configuration, when the second connection part 92 is in the first posture, i.e., when an external force is not applied to the second connection part 92, the flange part 95 is urged onto the urging part 96 to be in air-tight close contact with the sealing member 94 as illustrated in FIG. 3. As a result, the valve part 93 is n a closed state.

On the other hand, when a pressing force in the direction of the arrow C by the pressing part 82 of the operation part 8 acts on the second connection part 92, the second connection part 92 is displaced from the first posture to the second posture. The flange part 95 is thus displaced against the urging force of the urging part 96. As a result, a part (or the whole) of the peripheral part 951 of the flange part 95 is separated or becomes spaced from the sealing member 94. This results in the formation of a gap 98 between the flange part 95 and the sealing member 94 as illustrated in FIG. 4. As a result, the gas G flows from the first connection part 91 into the second connection part 92 via the gap 98. That is, the valve part 93 is rendered in an opened state.

With the opening and closing means 9 having the construction described above, the valve part 93 can be opened/closed in synchronization with the pressing operation by the operation part 8. As a result, when the valve part 93 is in a closed state, the flow of the gas G from the cylinder 300 to the nozzle 4 can be shut off with good reliability. On the other hand, when the valve part 93 is in an opened state, the flow of the gas G is permitted.

Incidentally, the materials of which the first connection part 91, the second connection part 92, the flange part 95, and the urging part 96 are fabricated are not limited to a particular material. By way of example, various metal materials and various plastics may be used alone or in combination.

The material of which the sealing member 94 is fabricated is also not particularly limited. As an example, various rubber materials such as natural rubber, butyl rubber, isoprene rubber, butadiene rubber, styrene-butadiene rubber, and silicone rubber can be used.

As shown in FIGS. 1 and 2, a nozzle 4 is set in the front plate 72 of the sprayer main body 7. The nozzle 4 ejects, together with the gas G (gas) which has passed through the tube 10, (liquid mixture of) the first liquid L1 which has passed through the reduced diameter part 22 of the first syringe 2, and the second liquid L2 which has passed through the reduced diameter part 22 of the second syringe 3.

The fixing member 41 is formed of, for example, a metal material or a resin material, and has an outer shape of a block. The fixing member 41 has a hollow part open at the distal end and the proximal end. The proximal end opening 411 of the fixing member 41 is fitted to the front plate 72 of the sprayer main body 7. As a result, the nozzle 4 is fixed to the sprayer main body 7.

The nozzle 4 includes a first internal tube 44*a* forming a liquid flow path through which the first liquid L1 passes. The first internal tube 44*a* is connected to the reduced diameter part 22 of the first syringe 2. The nozzle 4 also includes a second internal tube 44*b* forming a liquid flow path through which the second liquid L2 passes. The second internal tube 44*b* is connected to the reduced diameter part 22 of the second syringe 3. In addition, the nozzle 4 includes an external tube 43 in which the first internal tube 44*a* and the second internal tube 44*b* are positioned, a supply tube (gas supply tube) connected to a second tube 102 for supplying the gas G into the external tube 43, and the fixing member 41 by which the nozzle 4 is fixed to the front plate 72 of the sprayer main body 7.

The first internal tube 44*a* (the portion excluding the coil 42), the second internal tube 44*b* (the portion excluding the coil 42), the external tube 43, and the supply tube may each be formed of, for example a hard material, a soft material, an elastic material, and a material imparting flexibility. In this embodiment, each of the noted parts is formed of a material which imparts flexibility to the parts. Examples of the material in this regard include: various soft or hard resins including polyethylene, polypropylene, polycarbonate, polyesters such as polyethylene terephthalate and polyethylene naphthalate, polyamides (e.g., nylon 6, nylon 6•6, nylon 6•10, and nylon 12), and the like, silicone rubber, various thermoplastic elastomers of a polyurethane type, a polyester type, a polyamide type, an olefin type, a styrene type, and the like, stainless steel, and aluminum.

The first internal tube 44*a* and the second internal tube 44*b* have roughly the same configuration. Therefore, the following description of the first internal tube 44*a* applies equally to the second internal tube 44*b*.

The first internal tube 44*a* is an elongated tube-shaped body. The proximal end part of the first internal tube 44*a* is connected to the reduced diameter part 22 of the first syringe 2. This enables the first liquid L1 to be supplied from the first syringe 2 to the first internal tube 44*a*.

The first internal tube 44*a* has an ejection port 442 open at the distal end. The ejection port 442 is a site at which is ejected the first liquid L1 flowing from the reduced diameter part 22 of the first syringe 2 upon pressing and operating the operation part 8, and the gas G flowing from the cylinder 300 as shown in FIG. 7.

The first internal tube 44*a* and the second internal tube 44*b* configured in the manner described are positioned in the external tube 43 as shown in FIGS. 5-9. The external tube 43 is an elongated tube-shaped body. The proximal end part of the external tube 43 is connected to the distal end opening 412 of the fixing member 41. The gas G supplied via the supply tube passes through the gap or space between the external tube 43 and the first internal tube 44*a* and the second internal tube 44*b*. The gas G thus flows through a gas flow path generally defined between the external tube 43 and the first internal tube 44*a* and the second internal tube 44*b*.

The distal end part of the external tube 43 has a distal end wall part 432 so that the distal end is closed. The first internal tube 44*a* and the second internal tube 44*b* penetrate through the distal end wall part 432 so that respective ejection ports 442 are exposed. Between the distal end wall part 432 of the external tube 43 and the distal end parts of the first internal tube 44*a* and the second internal tube 44*b*, for example, a sealing member is set, so that the air tightness in the external tube 43 is kept. As a result, the gas G is prevented from leaking from between the distal end wall part 432 of the external tube 43 and the distal end parts of the first internal tube 44*a* and the second internal tube 44*b*.

As shown in FIGS. 1 and 2, the fixing member 41 is disposed at the proximal end part of the nozzle 4. The fixing member 41 includes a hollow body having a distal end opening 412 and the proximal end opening 411. To the distal end opening 412, the proximal end part of the external tube 43 is connected in an air-tight manner. The proximal end opening 411 is connected/fixed to the front plate 72 of the sprayer main body 7. Inside the fixing member 41 are positioned the connection part of the first internal tube 44*a* to the first syringe 2, the connection part of the second internal tube 44*b* to the second syringe 3, and the connection part of the supply tube to the tube 10. As a result, the respective connection parts are covered or enclosed so that the respective connection parts are protected.

As shown in FIGS. 5-9, a distal end portion of the wall part of the first internal tube 44*a* (the portion in the vicinity of the ejection port 422) is formed as a helically extending member or a coil 42. Similarly, a distal end portion of the wall part of the second internal tube 44*b* (the portion in the vicinity of the ejection port 422) is formed as a helically extending member or a coil 42. Both of the coils 42 have the same configuration and so it is to be understood that the following description of the coil 42 of the first internal tube 44*a* applies equally to the coil 42 of the second internal tube 44*a*. In the illustrated embodiment, the two coils 42 are spaced apart from another so that the axes of the two coils are not coaxial, but are laterally spaced from each other.

The coil 42 is set in such a manner as to cut the midway part (distal end part) of the first internal tube 44*a*, and to complement the cut part, namely, in such a manner as to bond the portion on the upstream side (proximal end side) and the downstream side (distal end side) of the first internal tube 44*a* via the cut part. The method of bonding or fixing the coil to the tube is not particularly limited. Examples of bonding methods include fusion (heat fusion, high frequency fusion, ultrasonic fusion, and the like), and adhesion (adhesion by an adhesive or a solvent). Thus, in this embodiment, one of the coils 42 forms a part of the first internal tube 44*a* and the other coil 42 forms a part of the second internal tube 44*b*. As illustrated, each coil 42 is positioned between a proximal internal tube portion and a distal internal tube portion.

The coil 42 is formed of a helically wound wire rod 422. In this embodiment, the coil 42 is preferably configured so that adjacent portions (windings) of the wire rod are separated from each other so that a gap 423 is formed between adjacent windings. The gap G is a continuous helically extending through gap. The gas G passing through the inside of the external tube 43 can flow into the coil 42 through the gap 423. This causes the gas G which has flowed into the coil 42 to be ejected from the ejection port 442 together with the first liquid L1 as shown in FIG. 7. Then, the first liquid L1 which has been ejected from the ejection port 442 is atomized, and mixed with the second liquid L2 which has similarly been ejected in an atomized form, to be sprayed onto the affected part.

Figure 8:
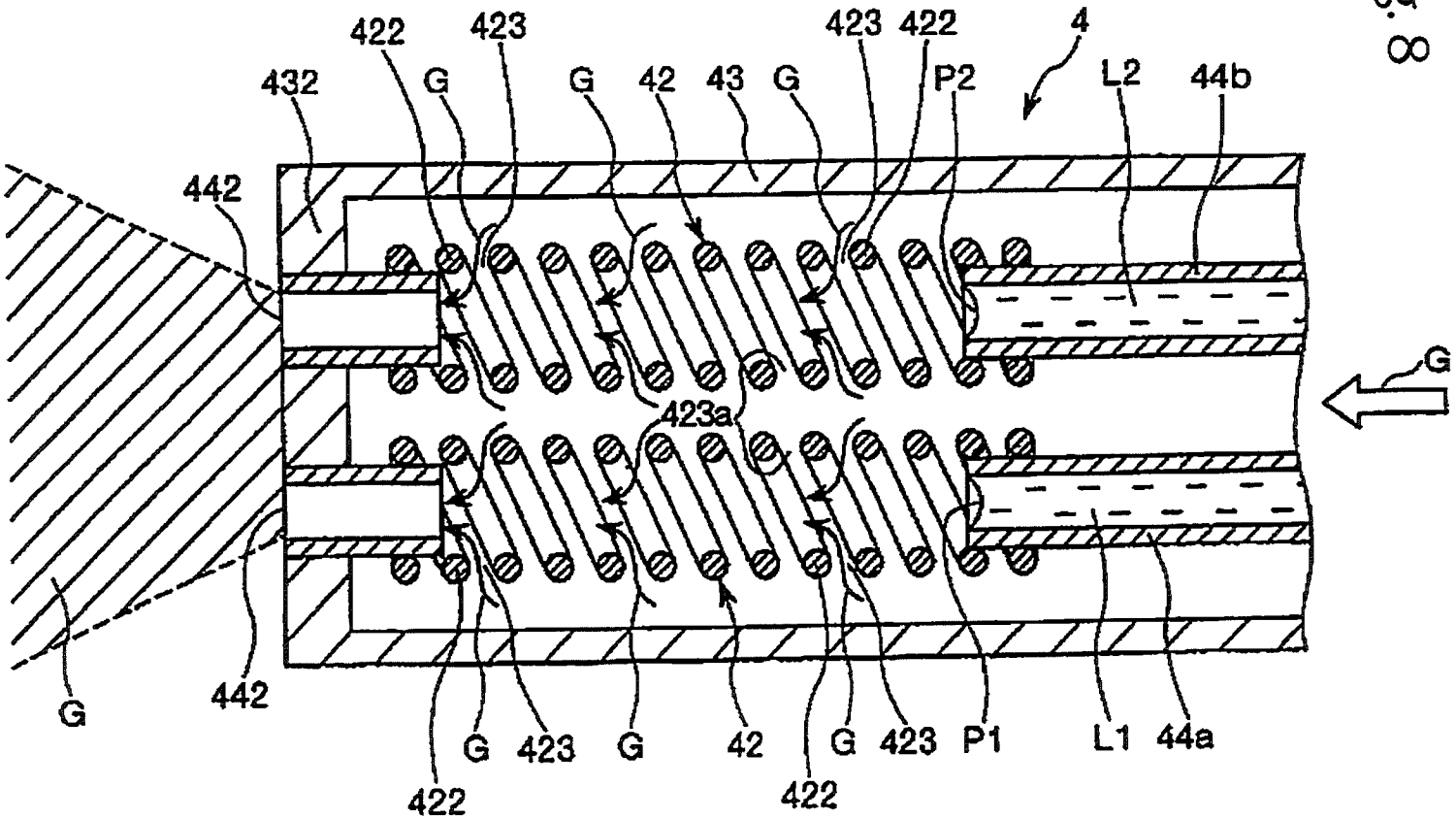
FIG. 8 is a longitudinal cross-sectional view similar to FIG. 5 illustrating the nozzle at a further time in the sprayed state.
Figure 9:
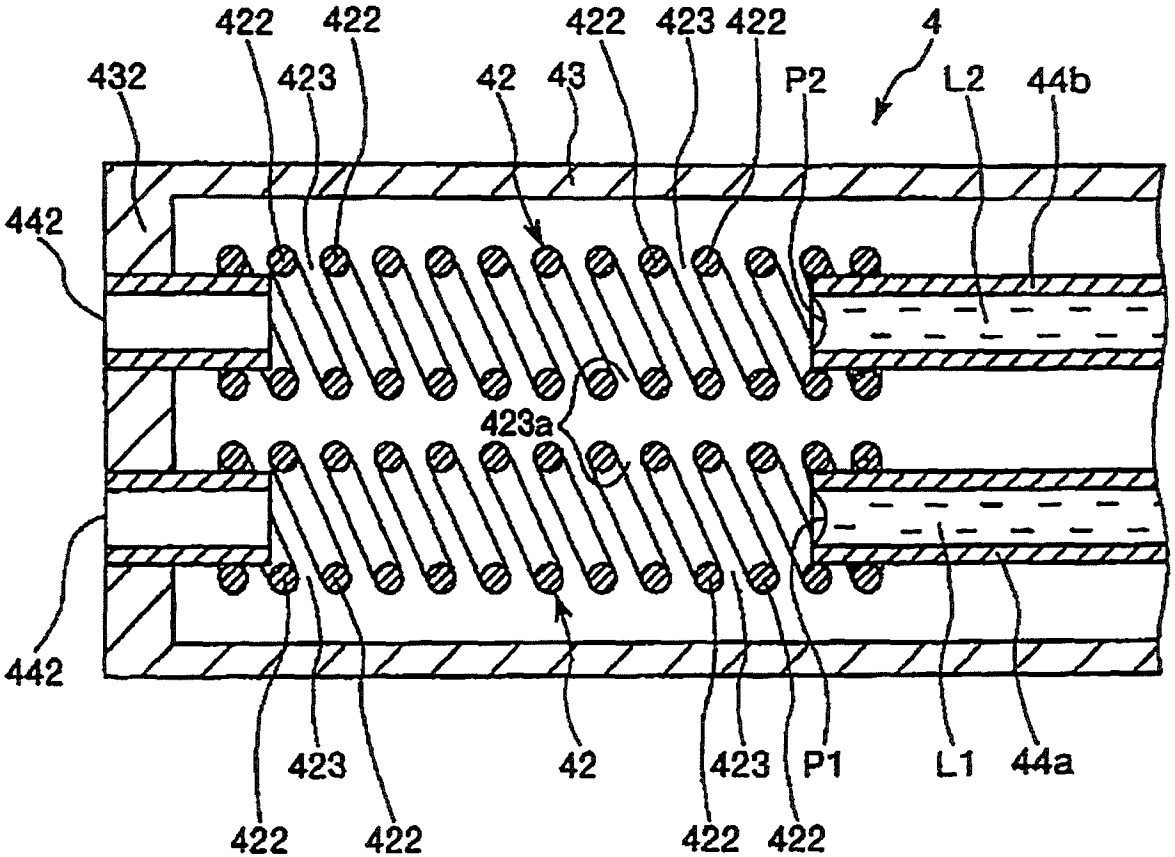
FIG. 9 is a longitudinal cross-sectional view similar to FIG. 5 illustrating the nozzle at a further time in the sprayed state.

The coil 42 is formed of the helically wound wire rod 422 as described above. With this structure, the gap 423 also becomes helical. This enables the gas G to flow into the first internal tube 44*a* from any circumferential portion of the coil 42 through the gap 423. As a result, it is possible to supply the gas G into the first internal tube 44*a* without it being too much or too little. Accordingly, the first liquid L1 ejected from the ejection port 442 is rendered in an atomized form with good reliability. By thus having been rendered in an atomized form, the first liquid L1 and the second liquid L2 are uniformly mixed, and sprayed in a preferred state (uniformly mixed state) to the affected part. As shown in FIG. 8, when ejection of the first liquid L1 is stopped, the gas G which has flowed through the gap 423 of the coil 42 outwardly blows the first liquid L1 at the portion closer to the distal end than the coil 42 in the first internal tube 44*a*. This helps prevent the first liquid L1 from remaining at the ejection port 422. As a result, clogging is inhibited, preferably prevented, from occurring in the ejection port 442 or nozzle 4 as depicted in FIG. 9.

The wire rod 422 forming the coil 42 possesses a circular cross-section. This results in a helical groove 423*a* between the adjacent portions of the external circumferential surface of the wire rod 422 in the internal circumferential part of the coil 42. The groove 423*a* is the portion on the inner side of the gap 423. When the first liquid L1 passes through the inside of the coil 42, a swirl flow is caused in the first liquid L1 by the groove 423*a* as shown in FIG. 7. As a result, the first liquid L1 is ejected from the ejection port 442 vigorously so it is sprayed at the affected part (in the form of a liquid mixture) with the second liquid L2.

The wire diameter of the wire rod 422 forming the coil 42 is not particularly limited. By way of example, the wire diameter is preferably 0.05 to 1.0 mm, more preferably 0.1 to 0.5 mm, and further preferably 0.1 to 0.15 mm.

The gap distance (gap length) u between the adjacent portions of the wire rod 422 is also not particularly limited, though it is preferably 0 to 0.1 mm, and more preferably 0 to 0.05 mm.

Though the material of which the wire rod 422 is made is not particularly limited, a material having the same flexibility (elasticity) as that of the first internal tube 44*a* can be used.

The coil 42 preferably has water repellency, namely hydrophobicity, against the first liquid L2 and the second liquid L2. As a result, the first liquid L1 in the coil 42 (the first internal tube 44*a*) is prevented from flowing (leaking) into the external tube 43 via the gap 423 of the coil 42 with reliability. It is possible to employ a coil 42 formed of a material having hydrophobicity, or a coil in which the outer circumferential surface of the wire rod 422 has been subjected to a hydrophobization processing. Examples of the material (constituent material) having hydrophobicity include: polytetrafluoroethylene (PTFE), a copolymer of ethylene and tetrafluoroethylene (ETFE), and polypropylene (PP). As an alternative to such resin materials, metal materials such as stainless steel can also be used. Though the hydrophobization processing is not particularly restricted, examples include a method in which the material having hydrophobicity is coated on the outer circumferential surface of the wire rod 422 (the surface of the coil 42).

Further, the coil 42 forms the distal end portion of the wall part of the first internal tube 44*a* in this embodiment. However, other variations are possible. For example, the coil 42 may form the whole of the wall part of the first internal tube 44*a*.

Further, the coil 42 on the first internal tube 44*a* side and the coil 42 on the second internal tube 44*b* side are mutually equal in pitch p in the illustrated embodiment. However, they may be different in pitch p. For example, considering the first liquid L1 and the second liquid L2, when the viscosity of one liquid is higher than the viscosity of the other liquid, the pitch p of the coil through which one liquid passes may be set larger than the pitch p of the coil through which the other liquid passes.

Set forth below is a description of operational aspects of the sprayer 1 in a usable state in which the first syringe 2 filled with the first liquid L1 and the second syringe 3 filled with the second liquid L2 are mounted in the sprayer and connected to the cylinder 300.

The first syringe 2 and the second syringe 3 are filled with the first liquid L1 and the second liquid L2 respectively in an amount necessary to be sprayed onto the affected part. For the cylinder 300, the valve 301 is in an opened state, which allows the gas G to be supplied to the sprayer 1.

For the sprayer 1, the force for causing the gap 98 between the sealing member 94 and the flange part 95 against the force of the urging part 96 which presses the flange part 95 against the sealing member 94, i.e., the pressing force in the direction of the arrow C to tilt the second connection part 92 from the first posture to the second posture, is set to be smaller than the force to move the plunger 26 of the first syringe 2 and the plunger 26 of the second syringe 3 in the direction of the distal end. In other words, before moving the plungers 26 of the syringes, the gap 98 is produced (i.e., the second connection part 92 is tilted from the first posture to the second posture), and the gas G is supplied. Example of ways to accomplish this involves setting (choosing) various conditions such as the spring constant of the urging part 96, the viscosity of each liquid, and the inner diameter of each external tube 21.

Figure 5:
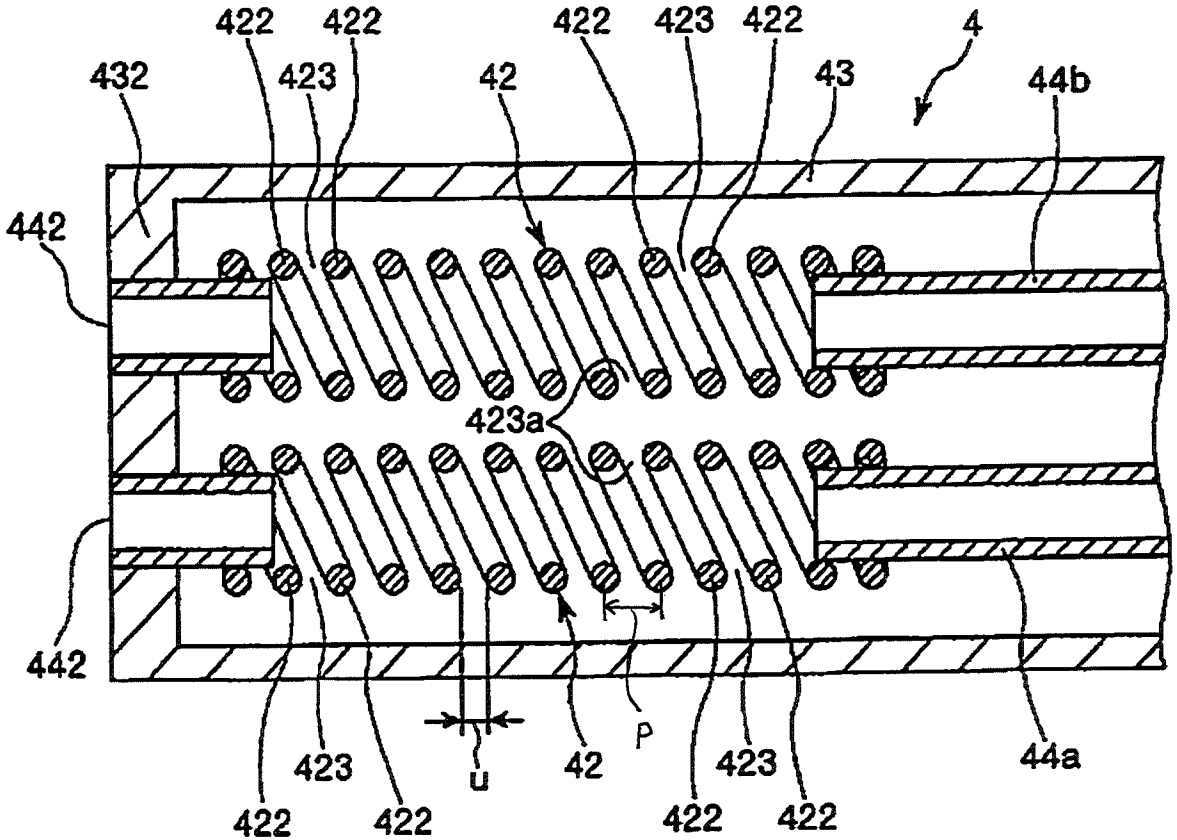
FIG. 5 is a longitudinal cross-sectional view of the nozzle of the sprayer shown in FIG. 1.

To operate the sprayer 1, an index finger is rested on the finger rest part 751 of the sprayer main body 7, a middle finger is rested on the finger rest part 752, and a thumb is rested on the pressing part 82 of the operation part 8. At this time, as shown in FIG. 5, the first liquid L1 is not supplied to the first internal tube 44*a*, the second liquid L2 is not supplied to the second internal tube 44*b*, and the gas G is not supplied to the external tube 43. Accordingly, the gas G, the first liquid L1, and the second liquid L2 are not ejected from the nozzle 4.

Figure 6:
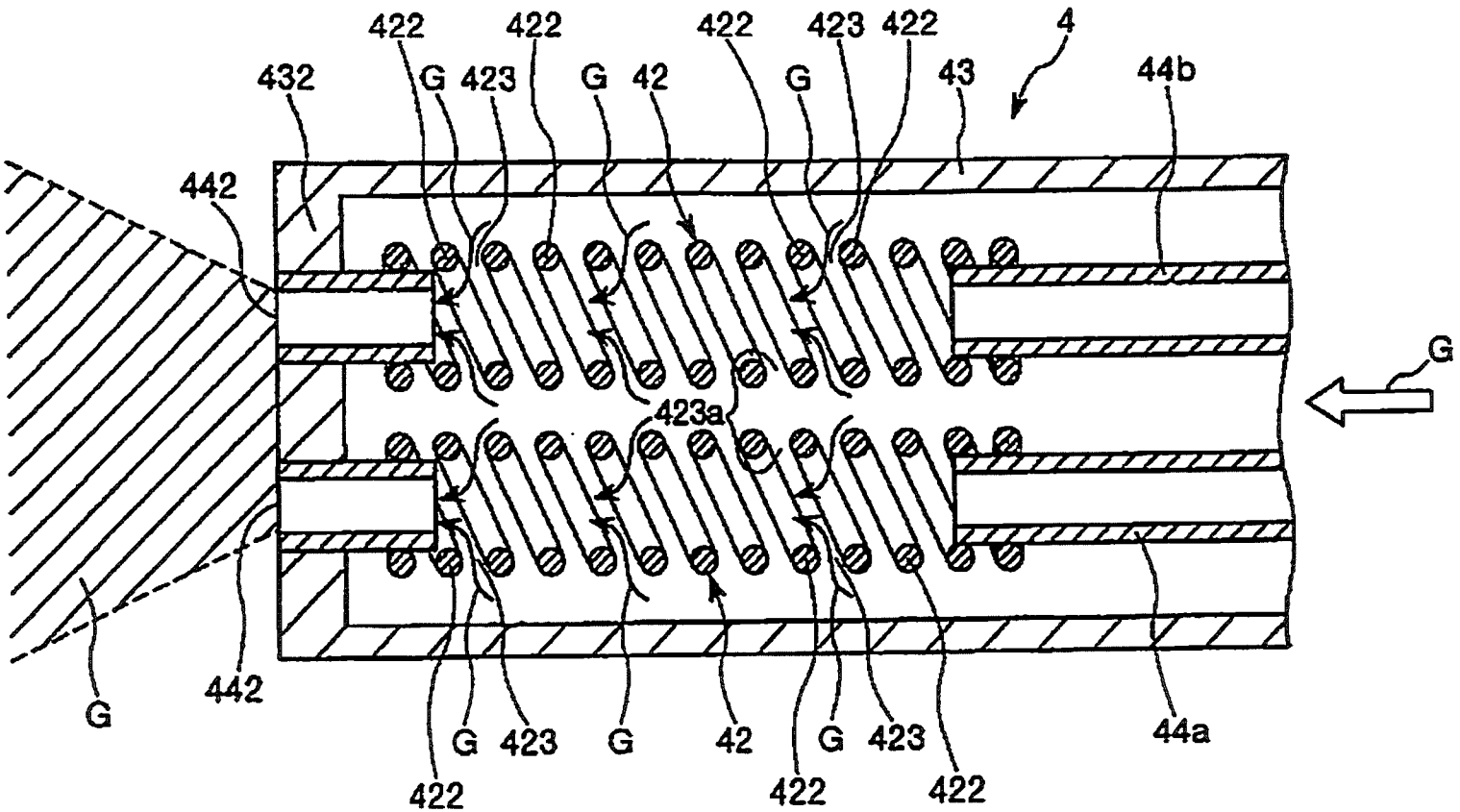
FIG. 6 is a longitudinal cross-sectional view similar to FIG. 5 illustrating the nozzle at a different time in the sprayed state.

When the pressing part 82 is pressed and operated with a thumb in this state, the second connection part 92 is first tilted. As a result, the gap 98 is caused between the sealing member 94 and the flange part 95. Thus, the gas G passes through the gap 98 to flow as shown in FIG. 4. As a result, the gas G flows into the supply tube through the second tube 102, and thereby further passes through the inside of the external tube 43. Then, when the gas G reaches the vicinity of each of the coils 42, it flows into the first internal tube 44*a* and the second internal tube 44*b* through a gap 423 of the coil 42. The gas G is ejected at high speed from each ejection port 442 as depicted in FIG. 6.

The pressing operation on the pressing part 82 by the thumb falls short of moving the whole operation part 8, namely each plunger 26 in the direction of the distal end. For this reason, the first liquid L1 and the second liquid L2 have not yet begun being supplied to the first internal tube 44*a* and the second internal tube 44*b*, respectively.

With further pressing of the pressing part 82, the second connection part 92 is tilted to the limit so that the pressing force from the thumb is transferred to the connection part 81 via the pressing part 82. As a result, the connection part 81 (the whole operation part 8) starts to move. Accordingly, the first liquid L1 is pushed out from the first syringe 2, and the second liquid L2 is also pushed out from the second syringe 3. The pushed first liquid L1 merges with the gas G in the coil 42, and ejects from the ejection port 442 of the first internal tube 44*a* together with the gas G as depicted in FIG. 7. In a similar manner, the second liquid L2 merges with the gas G in the coil 42, and ejects from the ejection port 442 of the second internal tube 44*b* together with the gas G as illustrated in FIG. 7.

The first liquid L1 and second liquid L2 ejected from respective ejection ports 442 are respectively atomized by the gas G which is being ejected at high speed. As a result, the first liquid L1 and the second liquid L2 are mutually mixed to be sprayed onto the affected part.

After completion of spraying of the mixture in a prescribed amount onto the affected part, the pressing force against the pressing part 82 (operation part 8) of the thumb is eased or released. Then, the movement of the whole operation part 8 is stopped. This stops the movement of each plunger 26 so that ejection of the first liquid L1 and the second liquid L2 is individually stopped as illustrated in FIG. 8. At this time, the second posture of the second connection part 92 by pressing of the pressing part 82 is maintained, and hence the gas G is still being ejected as FIG. 8 illustrates. Accordingly, in the first internal tube 44*a*, the first liquid L1 at the portion closer to the distal end than the coil 42 is pushed out of the ejection port 442 by the gas G which has flowed through the gap 423 of the coil 42. As a result, the distal end P1 of the first liquid L1 is situated in the vicinity of the proximal end part of the coil 42. Also in the second internal tube 44*b*, the second liquid L2 at the portion closer to the distal end than the coil 42 is pushed out of the ejection port 442 by the gas G which continues to flow through the gap 423 of the coil 42. As a result, the distal end P2 of the second liquid L2 is situated in the vicinity of the proximal end part of the coil 42.

With such a configuration, the first liquid L1 and the second liquid L2 are prevented from remaining in the vicinity of their respective ejection ports 442, respectively. Further, these liquids are prevented from being mixed (coming in contact with each other), and gelating. This helps prevent clogging from occurring in each ejection port 442.

When the pressing force against the pressing part 82 by the thumb is further eased, the thumb which has pressed the pressing part 82 is finally separated from the pressing part 82. As a result, the pressing force against the second connection part 92 is released. Thus, the second connection part 92 returns to the first posture. As a result, the gap 98 between the sealing member 94 and the flange part 95 disappears. That is, the sealing member 94 and the entire circumference of the peripheral part 951 of the flange part 95 come in close contact with each other as shown in FIG. 3. At this step, supply of the gas G to the external tube 43 is stopped as illustrated in FIG. 9.

In this manner, upon completing the operation of the sprayer 1, namely after use of the sprayer 1 (after spraying), clogging is inhibited and preferably prevented from occurring in the nozzle 4. The sprayer 1 with no clogging occurring therein can be used again for spraying to the affected part.

The sprayer 1 is configured such that the gas G is ejected in advance of the first liquid L1 and the second liquid L2 from the nozzle 4. This can help prevent only the first liquid L1 and the second liquid L2 from being ejected and sprayed onto the affected part. Further, the first liquid L1 and the second liquid L2 are respectively ejected in an atomized form by the gas G ejected in advance. As a result, these liquids are mixed with each other.

Further, even after the supply of the gas G has stopped (the state shown in FIG. 9), the gas G flows into the first internal tube 44*a* through the gap 423 of the coil 42 by the residual pressure in the external tube 43. Therefore, the first liquid L1 at the portion closer to the distal end than the coil 42 can be further blown away. This can help prevent clogging from occurring in each ejection port 442.

Figure 10:
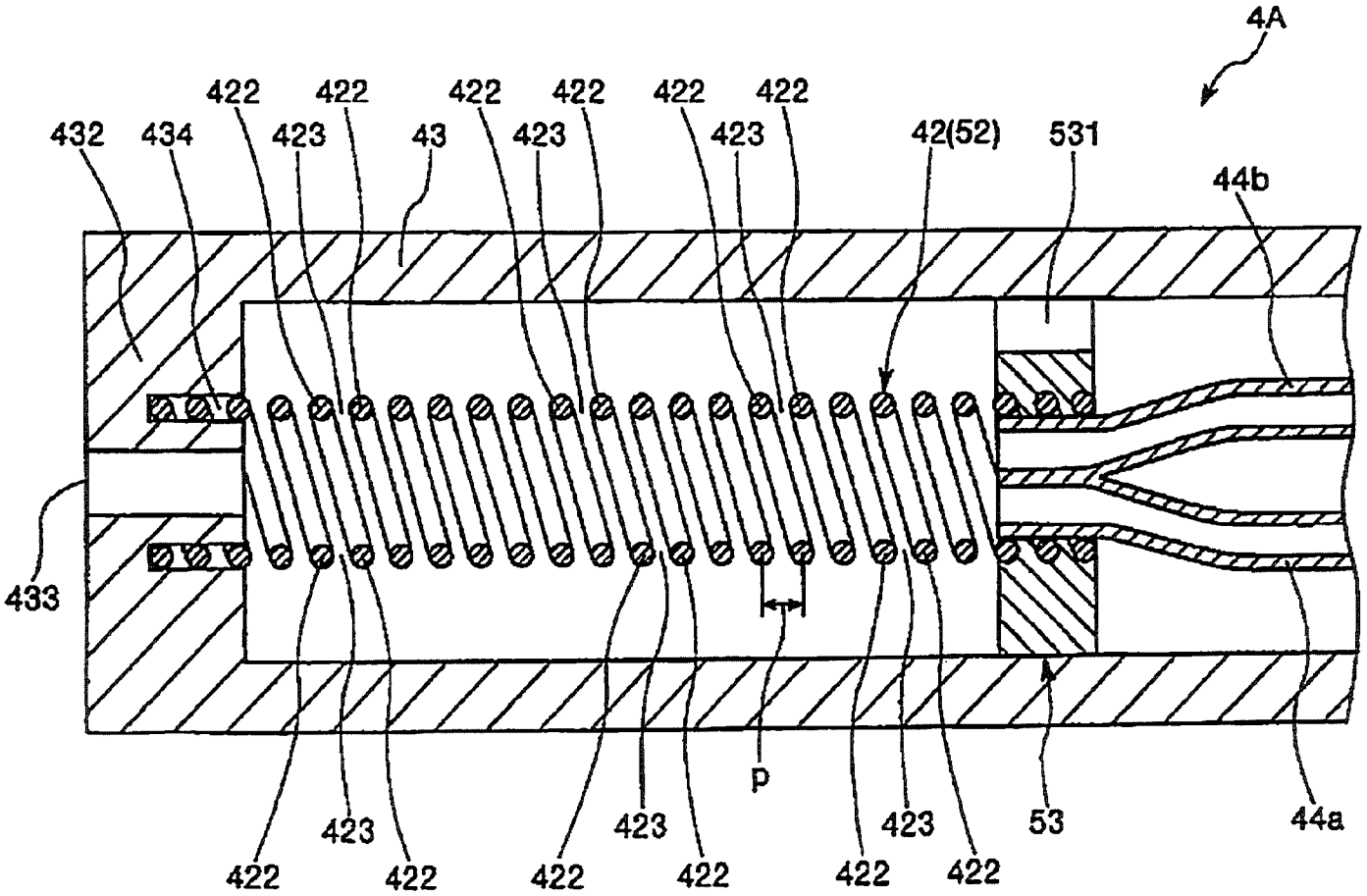
FIG. 10 is a longitudinal cross-sectional view of the nozzle of a sprayer according to a second embodiment.
Figure 11:
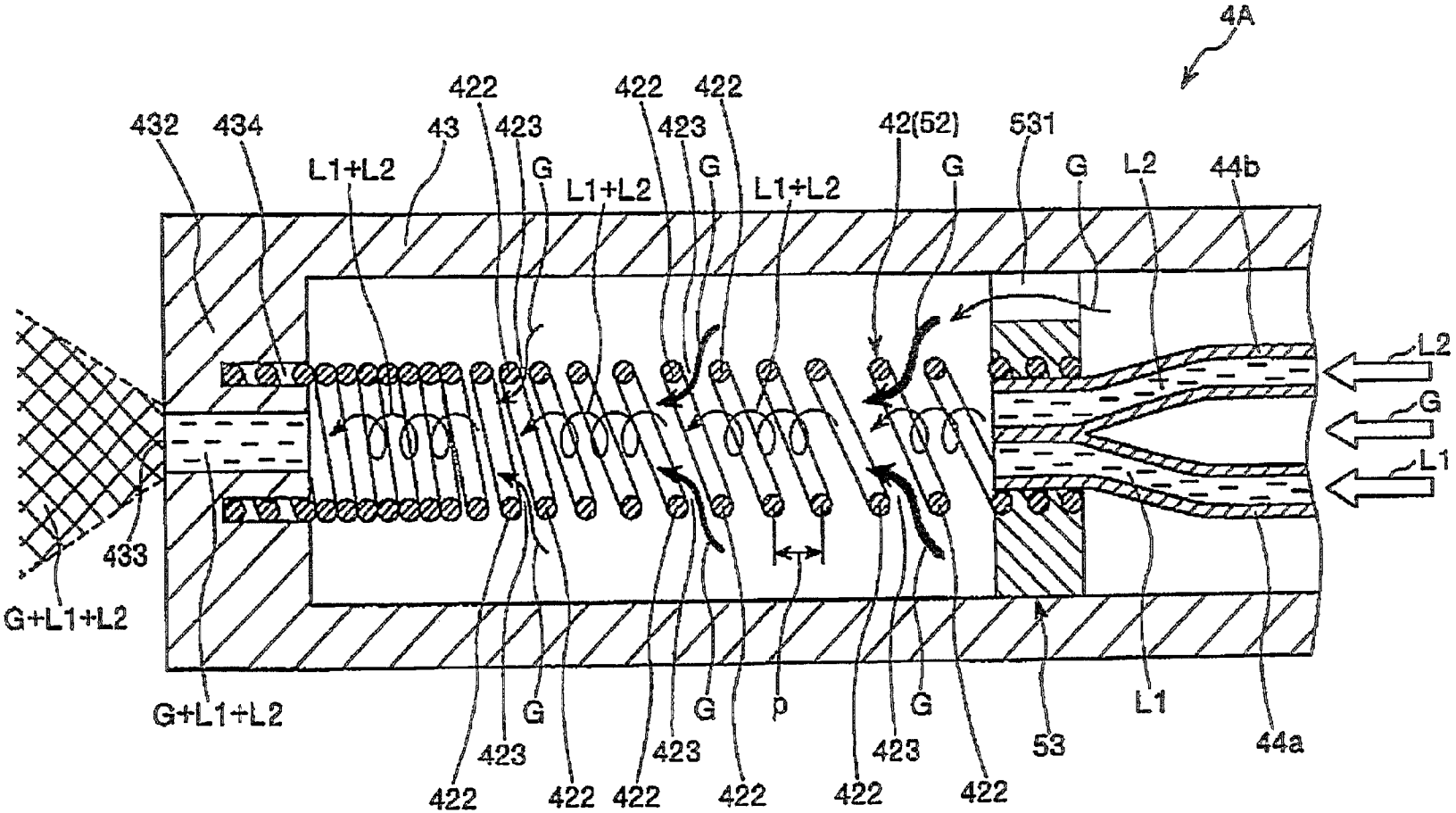
FIG. 11 is a longitudinal cross-sectional view similar to FIG. 10 illustrating the nozzle of the second embodiment of the sprayer at a different time in the sprayed state.
Figure 12:
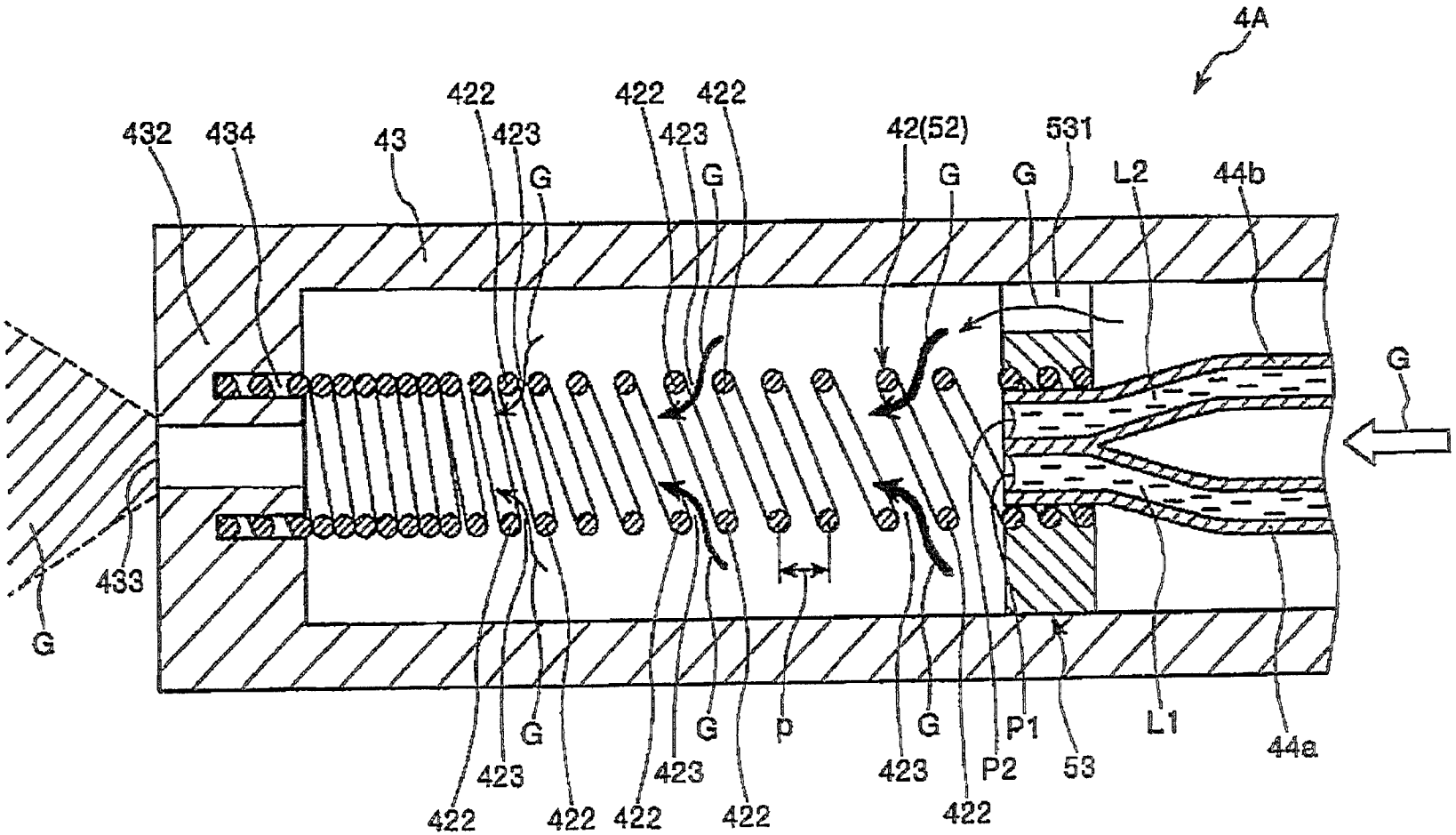
FIG. 12 is a longitudinal cross-sectional view similar to FIG. 10 illustrating the nozzle of the second embodiment of the sprayer at another time in the sprayed state.

FIGS. 10-12 illustrate the nozzle of the sprayer according to a second embodiment. The features associated with this second embodiment of the sprayer that are the same as those associated with the first embodiment are identified by common reference numerals and a detailed description of those features of the sprayer will not be repeated. The following description of the second embodiment will focus primarily on differences in the second embodiment relative to the first embodiment.

This second embodiment is the same as the first embodiment, except that the configuration of the internal tubes is different. More specifically, the nozzle is provided with a merge part.

In the nozzle 4A shown in FIGS. 10 to 12, the first internal tube 44*a* and the second internal tube 44*b* merge with each other into a single common tube at the portion on the distal end side (the distal end part) of each of the tubes. This results in the formation of a merge part 52 at which the internal spaces of the respective internal tubes merge with each other. At the merge part 52, the first liquid L1 and the second liquid L2 merge with one another and are mixed uniformly with each other, resulting in a liquid mixture. The entirety of the merge part 52 is formed of the coil 42.

A through hole is formed in the distal end wall part 432 of the external tube 43. The through hole penetrates in the direction of thickness of the end wall part. The through hole communicates with the merge part 52 (the inner side or interior of the coil 42), and functions as the ejection port 433 through which the liquid mixture formed or produced at the merge part 52 is ejected as shown in FIG. 11. A ring-shaped (annular) recess or concave part 434 is provided at the rear side (the proximal end side) of the distal end wall part 432. The ring-shaped recesses 434 is concentric with the ejection port 433 on the outer circumferential side of the ejection port 433. The distal end part of the coil 42 (i.e., the coil which forms the merge part 52) is positioned in the recess 434. As a result, the distal end part of the coil 42 is fixed (supported) to the external tube 43.

The proximal end part (rear part) of the coil 42 is supported and fixed to the external tube 43 via the fixing member 53. The fixing member 53 is a wall-shaped member disposed between the proximal end outer circumferential part of the coil 42 and the inner circumferential part of the external tube 43. At least one through hole 531 is provided in the fixing member 53. The at least one through hole 531 penetrates through the fixing member 53 in the direction of thickness of the fixing member 53. A gas can penetrate (pass) through the through hole 531 in the manner shown in FIGS. 11 and 12. The fixing member 53 is formed of, for example, a potting material such as polyurethane or silicone rubber.

The opposite ends (particularly, the proximal end) of the coil 42 are thus supported. As a result, when the liquid mixture passes through the inside of the coil 42, the coil 42 is inhibited, preferably prevented, from being involuntarily shifted by the forward force of the liquid mixture.

As described above, the whole of the merge part 52 is formed of the coil 42. As a result, by the operation of the operation part 8, upon stopping the ejection of the first liquid L1 and the second liquid L2, the gas G which has flowed through the gap 423 of the coil 42 into the merge part 52 (coil 42) can blow away the liquid mixture in the merge part 52 through the ejection port 433 as illustrated in FIG. 12. This can prevent the liquid mixture from remaining in the ejection port 433, which prevents clogging from occurring in the ejection port 433 (nozzle 4A).

The coil 42 is configured such that the pitch p between the adjacent portions of the wire rod 442 changes. As shown in FIG. 11, when the liquid mixture is being ejected, each wire rod (winding) 422 is pressed mainly by the force of the gas G pressing the wire rod 422 (surrounding gas pressure). Thus, the pitch p expands more than in the natural state (the state shown in FIG. 10) at the proximal end side portion of the coil 42. On the other hand, the pitch p is narrowed at the distal end side portion of the coil 42. As a result, the gas G flows in, in a larger amount, from the portion on the proximal end side of the coil 42 than from the portion on the distal end side. This helps enable the liquid mixture to be pressed out from the proximal end side as strongly as possible. Accordingly, the liquid mixture is ejected vigorously to be sprayed onto the affected part.

Then, when ejection of the liquid mixture is stopped, and ejection of the gas G is stopped, the force pressing the wire rod 422 disappears, so that the coil 42 is returned to the natural state. Namely, the pitch p narrows (returns to the original size) at the proximal end side portion of the coil 42, and the pitch p increases (returns to the original size) at the distal end side portion of the coil 42.

The method for thus making the pitch p variable according to the flow rate of the liquid mixture and the gas G is not particularly limited. For example, a method can be employed in which various conditions such as the wire diameter of the wire rod 422 and the constituent materials are appropriately selected.

As described above, a swirl flow is caused or created in the coil 42 as shown generally in FIG. 11. As a result, in the coil 42, the merged first liquid L1 and second liquid L2 are stirred. This allows ejection of the uniformly mixed liquid mixture of these liquids.

Further, the gas G which has flowed through the gap 423 of the coil 42 becomes bubbles in the liquid mixture. The bubbles also contribute to stirring the first liquid L1 and the second liquid L2 in the process of the bubbles passing through the merge part 52. This further improves the stirring efficiency.

Particularly, when the viscosities of both the liquids are different from each other, the liquids are less likely to be a uniform liquid mixture merely by being merged or mixed. However, the sprayer here exerts a stirring action to stir the first liquid L1 and the second liquid L2, and promote mixing of the two liquids of different compositions. This results in a more uniform liquid mixture.

The whole of the merge part 52 is formed of the coil 42 in this embodiment. However, the sprayer is not limited in this regard. For example, it is also possible that the portion on the proximal end side (proximal end) is formed of the coil 42.

Figure 13:
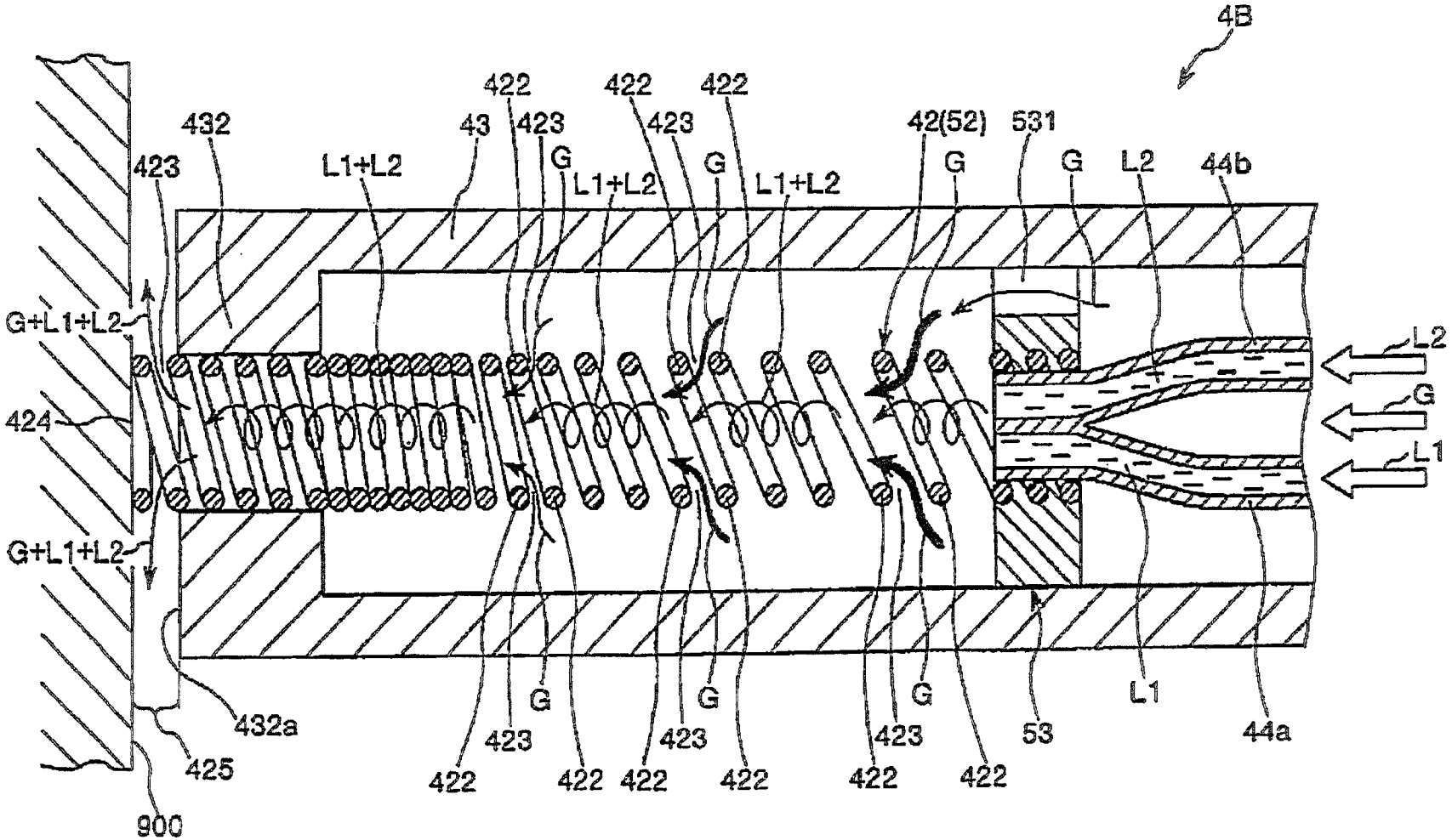
FIG. 13 is a longitudinal cross-sectional view of the nozzle of a sprayer according to a third embodiment.

FIG. 13 illustrates the nozzle of the sprayer according to a third embodiment. The features associated with this third embodiment of the sprayer that are the same as those associated with the embodiments described above are identified by common reference numerals and a detailed description of those features of the sprayer will not be repeated. The following description of the third embodiment will focus primarily on differences between this third embodiment and the embodiments described previously.

This embodiment is the same as the second embodiment, except that the setting state of the coil is different.

With the nozzle 4B shown in FIG. 13, the distal end part of the coil 42 forming the merge part 52 penetrates through the distal end wall part 432 of the external tube 43. Accordingly, the distal end (ejection port 424) of the coil 42 protrudes more than, or distally beyond, the distal end 432*a* of the external tube 43 (below, the protruding part is referred to as a "protrusion part 425"). Further, the distal end of the coil 42 functions as the ejection port 424 through which the liquid mixture is ejected.

With the nozzle 4B configured in the manner shown in FIG. 13, when the distal end of the nozzle 4B, namely the ejection port 424 of the nozzle 4B, comes in contact with and presses an organ 900 for use of the sprayer 1, the protrusion part 425 shrinks, and functions as the buffer part for relaxing the pressing force. This inhibits, preferably prevents, the organ 900 from being excessively pressed by the nozzle 4B.

Further, in the state shown in FIG. 13, the ejection port 424 is closed by the organ 900. However, the liquid mixture can flow to the outside through the gap 423 at the protrusion part 425. This can help prevent the liquid mixture and/or the gas G from flowing back through the inside of the coil 42, and going toward the downstream side of each internal tube, or from flowing into the external tube 43 through the gap of the coil 42.

Figure 14:
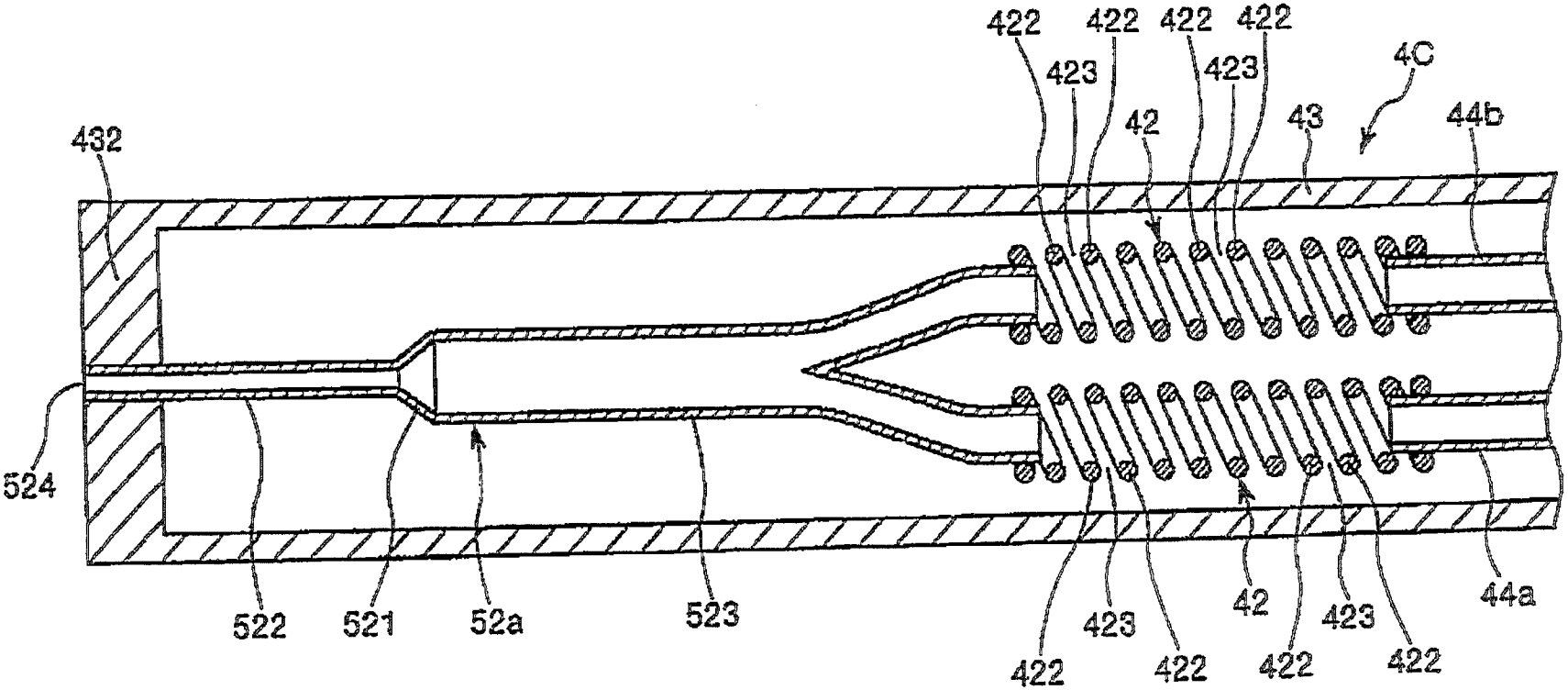
FIG. 14 is a longitudinal cross-sectional view of the nozzle of a fourth embodiment of the sprayer.
Figure 15:
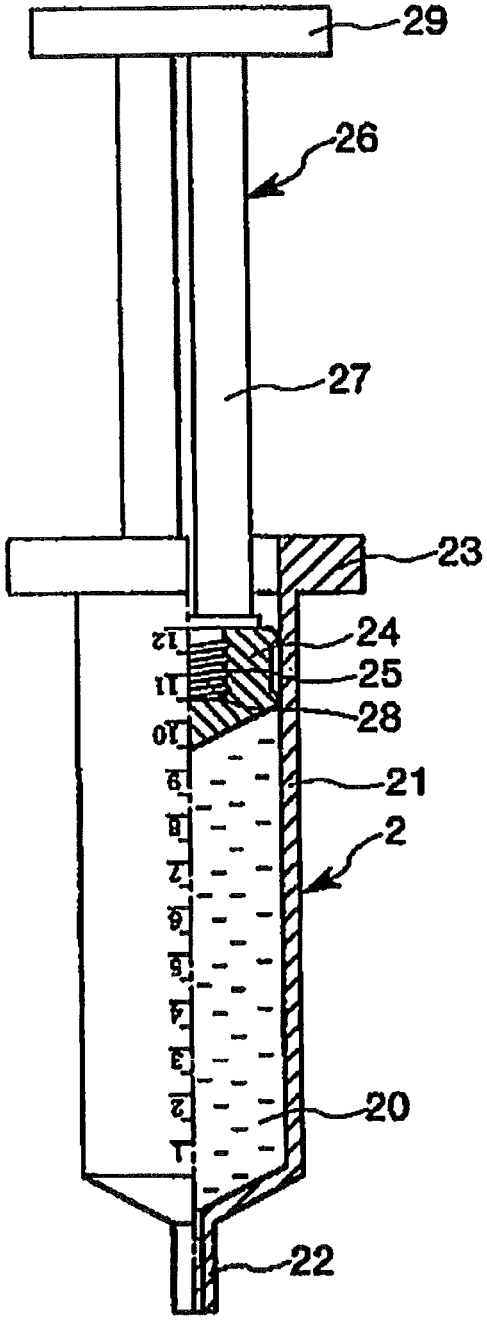
FIG. 15 is a longitudinal cross-sectional view of a syringe to be mounted in the sprayer shown in FIG. 1 and other disclosed embodiments, it being understood that the second syringe to be mounted to the disclosed embodiments of the sprayer can have the same construction.

FIG. 14 illustrates the nozzle of the sprayer according to a fourth embodiment. The features associated with this fourth embodiment of the sprayer that are the same as those associated with the embodiments described above are identified by common reference numerals and a detailed description of those features of the sprayer will not be repeated. The following description of the fourth embodiment will focus primarily on differences between this fourth embodiment and the embodiments described previously.

This fourth embodiment is the same as the second embodiment, except that the setting position of the coil is different.

With the nozzle 4C shown in FIG. 14, the merge part 52*a* has a taper part 521 gradually decreasing in internal diameter toward the direction of the distal end. Through the taper part 521, the merge part 52 is divided into a small diameter part 522 with a small internal diameter on the distal end side, and a large diameter part 523 with a large internal diameter on the proximal end side. The distal end opening of the small diameter part 522 functions as an ejection port 524 for ejecting the liquid mixture (a mixture of the first liquid L1 and the second liquid L2) together with the gas G.

As another part of the nozzle 4C, coils 42 are set at the first internal tube 44*a* and the second internal tube 44*b*, respectively. Each coil 42 is positioned in the vicinity of the merge part 52. That is, the coils 42 are positioned just proximal of the merge part 52. Stated differently, the merge part 52 is located distally of the distal most ends of the two coils 42. In the illustrated embodiment, the coils 42 are spaced apart from another so that the axes of the two coils are not coaxial, but are laterally spaced from one another.

With the nozzle 4C configured in the manner shown in FIG. 14, by the operation of the operation part 8, upon stopping the ejection of the first liquid L1 and the second liquid L2, the gas G which has flowed in through the gaps 423 of each coil 42 can blow away not only the liquid mixture in the merge part 52, but also the first liquid L1 in the first internal tube 44*a* (coil 42) and the second liquid L2 in the second internal tube 44*b* (coil 42) through the ejection port 524 with reliability. This can prevent the first liquid L1 and the second liquid L2 from remaining in the ejection port 524, and causing clogging in the ejection port 524.

The coils 42 are set in the first internal tube 44*a* and the second internal tube 44*b*, respectively, in the configuration shown in FIG. 14. However, the configuration of the sprayer is not limited in this regard. For example, it is also possible that the coil is set in only one internal tube of the first internal tube 44*a* and the second internal tube 44*b*. For example, when the coil 42 is set only in the first internal tube 44*a*, by the operation of the operation part 8, upon stopping the ejection of the first liquid L1 and the second liquid L2, the gas G which has flowed in the first internal tube 44*a* through the gap 423 of the coil 42 on the first internal tube 44*a* side blows away the liquid mixture in the merge part 52 and the first liquid L1 in the first internal tube 44*a* (coil 42) from the ejection port 524. At this step, the pressure in the second internal tube 44*b* communicating with the merge part 52 decreases. Accordingly, the second liquid L2 in the second internal tube 44*b* also flows into the merge part 52 to be blown away through the ejection port 524. This can help prevent the first liquid L1 and the second liquid L2 from remaining in the ejection port 524, and causing clogging in the ejection port 524.

The sprayer disclosed here has been described and illustrated by way of various embodiments. However, the invention is not limited in this regard. Respective parts forming each sprayer can be replaced with the parts having a different configuration capable of exhibiting the same or similar functions. Further, additional features can be added to the sprayer.

Further, the sprayer may include a combination of two or more configurations (features) of the respective embodiments disclosed here.

Further, the coil forming a part of the internal tube is configured such that the adjacent portions of the wire rod are separated from each other. However, the invention is not limited in this regard. For example, the coil may be configured such that the adjacent portions of the wire rod are in contact with each other. In the case of the coil configured such that the adjacent portions of the wire rod are in contact with each other, the adjacent portions of the wire rod are separated from each other by the gas pressure, so that the gas flows into the coil. In this case, the portion of the internal tube except for the coil preferably has flexibility. Further, the rear end of the coil and the part of the internal tube except for the coil are connected in an unfixed state. Namely, the rear end of the coil is preferably not the fixed end but the free end.

Further, the coil forming a part of the internal tube is not limited to the coil configured such that the rod diameter of the wire rod is constant. For example, the coil may be a coil having portions with different rod diameters.

Still further, the coil forming a part of the internal tube may be a coil formed of a doubly wound wire rod (double winding).

The principles, embodiments and modes of operation of the sprayer have been described in the foregoing specification, but the invention which is intended to be protected is not to be construed as limited to the particular embodiments disclosed. The embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A sprayer comprising:

a first liquid supply comprising a first liquid having a first composition;

a second liquid supply comprising a second liquid having a second composition different from the first composition;

a gas supply comprising a gas;

a nozzle comprised of an outer tube possessing an interior, a first internal tube positioned in the interior of the outer tube, and a second internal tube positioned in the interior of the outer tube;

the first internal tube possessing an interior, the first internal tube being connected to the first liquid supply so the interior of the first internal tube is in fluid communication with the first liquid supply so the first liquid from the first liquid supply is flowable into the interior of the first internal tube during operation of the sprayer;

the second internal tube possessing an interior, the second internal tube being connected to the second liquid supply so the interior of the second internal tube is in fluid communication with the second liquid supply so the second liquid from the second liquid supply is flowable into the interior of the second internal tube during operation of the sprayer;

the interior of the outer tube being connected to the gas supply so that the interior of the outer tube is in fluid communication with the gas supply so the gas from the gas supply is flowable into the interior of the outer tube during operation of the sprayer;

a coil located in the interior of the outer tube, the coil comprising a plurality of adjacent helical windings defining a fluid passage through an interior of the coil, the interior of the coil configured to be in fluid communication with the interior of the outer tube such that gas flowing into the interior of the outer tube from the gas source during operation of the sprayer flows between the adjacent helical windings and into the interior of the coil; and the interior of the first internal tube configured to be in fluid communication with the interior of the coil so that the first liquid flows through both the first internal tube and the interior of the coil.

2. The sprayer according to claim 1, wherein the first internal tube comprises a tube wall, the coil being a first coil and forming a part of the tube wall of the first internal tube, the second internal tube comprises a tube wall, and a second coil positioned in the interior of the outer tube and forming a part of the tube wall of the second internal tube.

3. The sprayer according to claim 2, wherein the first internal tube and the second internal tube merge together at a merge part at which the first liquid and the second liquid are mixed together, the merge part being positioned distally of a distal most end of the first and second coils.

4. The sprayer according to claim 1, wherein the first internal tube and the second internal tube merge together at a merge part, the coil being the merge part.

5. The sprayer according to claim 1, wherein the outer tube comprises an end wall part having a through hole communicating with the interior of the outer tube, the coil having a distal end portion extending through the through hole, a distal end of the coil being positioned distally beyond a distal most end of the outer tube.

6. The sprayer according to claim 1, wherein said coil has a longitudinal axis, said fluid passage through the interior of the coil being defined along the longitudinal axis.

* * * * *